US009703220B1

(12) United States Patent
Hirano et al.

(10) Patent No.: US 9,703,220 B1
(45) Date of Patent: Jul. 11, 2017

(54) IMAGE FORMING METHOD AND TONER SET

(71) Applicant: Konica Minolta, Inc., Tokyo (JP)

(72) Inventors: Shiro Hirano, Hachioji (JP); Noboru Ueda, Mitaka (JP); Kouji Sugama, Musashino (JP); Junya Onishi, Hachioji (JP); Aya Shirai, Hino (JP); Tatsuya Fujisaki, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/278,727

(22) Filed: Sep. 28, 2016

(30) Foreign Application Priority Data

May 19, 2016 (JP) ..... 2016-100828

(51) Int. Cl.
*G03G 9/097* (2006.01)
*G03G 9/09* (2006.01)
*G03G 9/087* (2006.01)

(52) U.S. Cl.
CPC ..... *G03G 9/091* (2013.01); *G03G 9/08711* (2013.01); *G03G 9/08755* (2013.01); *G03G 9/08797* (2013.01); *G03G 9/0918* (2013.01); *G03G 9/0926* (2013.01)

(58) Field of Classification Search
CPC ..... G03G 9/09708; G03G 9/08755
See application file for complete search history.

(56) References Cited

U.S. PATENT DOCUMENTS

| | | | | |
|---|---|---|---|---|
| 2002/0048010 | A1 | 4/2002 | Inaba et al. | |
| 2012/0156610 | A1* | 6/2012 | Nosella | G03G 9/0804 430/137.14 |
| 2015/0153663 | A1* | 6/2015 | Sheik-Qasim | G03G 9/0804 430/137.13 |
| 2015/0220009 | A1 | 8/2015 | Sato et al. | |

FOREIGN PATENT DOCUMENTS

| | | | |
|---|---|---|---|
| JP | 2002108019 | A | 4/2002 |
| JP | 2005-091986 | A | 4/2005 |
| JP | 2012-133353 | A | 7/2012 |
| JP | 2013-072969 | A | 4/2013 |
| JP | 2015-064449 | A | 4/2015 |
| JP | 2015148724 | A | 8/2015 |
| WO | 2010/001825 | A1 | 1/2010 |

OTHER PUBLICATIONS

Official Decision for Grant dated Dec. 13, 2016 from the corresponding Japanese Application No. JP 2016-100828; English translation of Official Decision for Grant ; Applicant: Konica Minolta, Inc.; Total of 6 pages.

* cited by examiner

*Primary Examiner* — Peter Vajda
(74) *Attorney, Agent, or Firm* — Lucas & Mercanti, LLP

(57) ABSTRACT

The present invention relates to an image forming method using a yellow toner, a magenta toner, and a cyan toner, in which the yellow toner, the magenta toner, and the cyan toner respectively contain toner base particles containing a binder resin containing an amorphous polyester resin as a main component and a crystalline resin, aluminum, and a colorant, and the concentration of aluminum in the toner base particles of the yellow toner measured by high-frequency inductively coupled plasma emission spectral analysis satisfies a specific relation. According to the present invention, an image forming method and a toner set which can improve the thin paper separation property while maintaining favorable low temperature fixability are provided.

9 Claims, No Drawings

IMAGE FORMING METHOD AND TONER SET

CROSS-REFERENCE TO RELATED APPLICATION

This application is based on Japanese Patent Application No. 2016-100828 filed on May 19, 2016, the contents of which are incorporated herein by reference.

BACKGROUND

1. Technical Field

The present invention relates to an image forming method and a toner set.

2. Description of Related Art

In recent years, a toner exhibiting excellent low temperature fixability has been demanded in order to fix a toner image with less energy than in the prior art from the viewpoint of an increase in speed and energy saving. It is required to lower the melting temperature or melt viscosity of the binder resin which constitutes the toner in order to lower the fixing temperature of the toner.

Moreover, a technique has been demanded which can improve not only the low temperature fixability but also other properties in association with the request for the diversification or image quality enhancement of printed matters in recent years.

For example, a toner having toner particles which contain a polyester resin as a main component and further contain styrene-(meth)acrylic resin particles and a trace amount of aluminum element has been proposed in JP 2015-148724 A (corresponding to US 2015/220,009 A1, the same shall apply hereinafter) as a technique related to the image quality enhancement of fixed image which has been demanded more and more in recent years. The polyester resin exhibits excellent sharp meltability and has an advantage that the softening point can be easily lowered while maintaining a higher glass transition temperature (Tg) as compared to a styrene-acrylic resin. Moreover, according to the toner, it is possible to suppress the gloss unevenness of a halftone image while maintaining low temperature fixability.

In addition, a toner having toner particles which contain a specific amount of a specific element such as magnesium or calcium together with a sulfur element-containing polymer has been proposed in JP 2002-108019 A (corresponding to US 2002/048,010 A1, the same shall apply hereinafter).

SUMMARY

The diversification of media (recording medium) such as from thick paper to thin paper and from coated paper to rough paper proceeds in association with the diversification of printed matters in recent years, and the level of properties required at the time of image output using a full-color toner in accordance with this has been increased more and more. Among them, a technique which can improve the separation property (thin paper separation property) of these media even in the case of using thin paper as a medium is demanded at the time of image output by superimposition of a full-color toner.

However, it is difficult to obtain sufficient thin paper separation property even by a technique of the related art as disclosed in JP 2015-148724 A and JP 2002-108019 A. Hence, a technique which can improve the thin paper separation property as well as the low temperature fixability is demanded.

Accordingly, an object of the present invention is to provide an image forming method and a toner set which can improve the thin paper separation property while maintaining favorable low temperature fixability.

In order to achieve at least one of the above objects, the image forming method that reflects one aspect of the present invention is an image forming method using a yellow toner, a magenta toner, and a cyan toner, in which the yellow toner, the magenta toner, and the cyan toner respectively contain toner base particles containing a binder resin containing an amorphous polyester resin as a main component and a crystalline resin, aluminum, and a colorant, and Al (Y), Al (M), and Al (C) are from 300 to 1500 ppm and satisfy the following Formula (1) and Formula (2) wherein Al (Y) (unit: ppm) is a concentration of aluminum in the toner base particles of the yellow toner, Al (M) (unit: ppm) is a concentration of aluminum in the toner base particles of the magenta toner, and Al (C) (unit: ppm) is a concentration of aluminum in the toner base particles of the cyan toner that are measured by high-frequency inductively coupled plasma emission spectral analysis.

[Numerical Formula 1]

$$1.3 \leq Al(Y)/Al(M) \leq 5.0 \ldots \quad (1)$$

$$1.3 \leq Al(Y)/Al(C) \leq 5.0 \ldots \quad (2)$$

In addition, in order to achieve at least one of the above objects, the toner set that reflects another aspect of the present invention is a toner set including a yellow toner, a magenta toner, and a cyan toner, in which the yellow toner, the magenta toner, and the cyan toner respectively contain toner base particles containing a binder resin containing an amorphous polyester resin as a main component and a crystalline resin, aluminum, and a colorant, and Al (Y), Al (M), and Al (C) are from 300 to 1500 ppm and satisfy the following Formula (5) and Formula (6) wherein Al (Y) (unit: ppm) is a concentration of aluminum in the toner base particles of the yellow toner, Al (M) (unit: ppm) is a concentration of aluminum in the toner base particles of the magenta toner, and Al (C) (unit: ppm) is a concentration of aluminum in the toner base particles of the cyan toner that are measured by high-frequency inductively coupled plasma emission spectral analysis.

[Numerical Formula 2]

$$1.3 \leq Al(Y)/Al(M) \leq 5.0 \ldots \quad (5)$$

$$1.3 \leq Al(Y)/Al(C) \leq 5.0 \ldots \quad (6)$$

DETAILED DESCRIPTION

Hereinafter, embodiments of the present invention will be described in detail. Incidentally, the present invention is not limited to the following embodiments. In addition, in the present specification, the term "X to Y" to indicate the range includes X and Y and means "X or more and Y or less". In addition, the operations and the measurement of physical properties and the like are conducted under a condition of room temperature (25° C.)/relative humidity of from 40 to 50% RH unless otherwise stated.

The first embodiment of the present invention is an image forming method using a yellow toner, a magenta toner, and a cyan toner, in which the yellow toner, the magenta toner, and the cyan toner respectively contain toner base particles containing a binder resin containing an amorphous polyester resin as a main component and a crystalline resin, aluminum, and a colorant, and Al (Y), Al (M), and Al (C) are from 300 to 1500 ppm and satisfy the following Formula (1) and Formula (2) wherein Al (Y) (unit: ppm) is a concentration of aluminum in the toner base particles of the yellow toner, Al (M) (unit: ppm) is a concentration of aluminum in the toner base particles of the magenta toner, and Al (C) (unit: ppm) is a concentration of aluminum in the toner base particles of the cyan toner that are measured by high-frequency inductively coupled plasma emission spectral analysis.

[Numerical Formula 3]

$$1.3 \leq Al(Y)/Al(M) \leq 5.0 \ldots \quad (1)$$

$$1.3 \leq Al(Y)/Al(C) \leq 5.0 \ldots \quad (2)$$

In addition, the second embodiment of the present invention is a toner set including a yellow toner, a magenta toner, and a cyan toner, in which the yellow toner, the magenta toner, and the cyan toner respectively contain toner base particles containing a binder resin containing an amorphous polyester resin as a main component and a crystalline resin, aluminum, and a colorant, and Al (Y), Al (M), and Al (C) are from 300 to 1500 ppm and satisfy the following Formula (5) and Formula (6) wherein Al (Y) (unit: ppm) is a concentration of aluminum in the toner base particles of the yellow toner, Al (M) (unit: ppm) is a concentration of aluminum in the toner base particles of the magenta toner, and Al (C) (unit: ppm) is a concentration of aluminum in the toner base particles of the cyan toner that are measured by high-frequency inductively coupled plasma emission spectral analysis.

[Numerical Formula 4]

$$1.3 \leq Al(Y)/Al(M) \leq 5.0 \ldots \quad (5)$$

$$1.3 \leq Al(Y)/Al(C) \leq 5.0 \ldots \quad (6)$$

In the image forming method and the toner set according to the present invention, the aluminum concentration in the respective color toners is within a specific range, and the aluminum concentration of the color toner satisfies a specific relation among the respective colors. Consequently, according to the present invention, an image forming method and a toner set which can improve the thin paper separation property while maintaining favorable low temperature fixability are provided.

Incidentally, the toner set here refers to a combination of toners to form different image forming layers when being transferred onto a recording medium.

In addition, in the present specification, the term "ppm" is based on mass and represents the term "ppm by mass" unless otherwise stated. The concentration of aluminum in the toner base particles is measured by high-frequency inductively coupled plasma emission spectral analysis (ICP emission spectral analysis), and more specifically, it can be measured by the method described in Examples.

According to the image forming method according to the present invention, it is possible to improve the thin paper separation property while maintaining favorable low temperature fixability. In addition, by using the toner set according to the present invention, an effect the same as that described above is also obtained. The action mechanism through which the effect described above is obtained by the configuration of the present invention is unclear, but it is considered as follows.

It is considered that aluminum contained in the toner base particles is present in the form of an ion and it forms a crosslinked structure (network) with a polar group (in particular, a remaining carboxyl group) contained in the binder resin. Moreover, the crosslinked structure can be formed in a moderate range as aluminum (ion) to form such a crosslinked structure is contained at a concentration of from 300 to 1500 ppm in the toner base particles of the three kinds of color toners (yellow toner, magenta toner, and cyan toner), and thus it is possible to maintain the resin elasticity at a high temperature (high temperature elasticity) while maintaining favorable low temperature fixability. When the aluminum concentration is less than 300 ppm, the manifestation of the ion crosslinking effect by aluminum is not sufficient, the high temperature elasticity decreases to decrease the melt viscosity, and the fixation separation property (paper winding property to the fixing member) of the medium (recording medium) deteriorates when an image by superimposition of a full-color toner is output. This tendency is a particularly remarkable especially when thin paper is used as a medium. In addition, a decrease in image quality due to hot offset occurs since high temperature elasticity decreases as described above. On the other hand, when the aluminum concentration is higher than 1500 ppm, elasticity increases too high by an excessive ion crosslinking effect and the low temperature fixability decreases.

In contrast, in the present invention, as described above, the toner base particles of the three kinds of color toners contain aluminum at a specific concentration, and thus the high temperature elasticity is maintained and the resin elasticity is moderately controlled so that not only low temperature fixability is favorably maintained but also the separation property of the media is favorable even in the case of using thin paper as a medium (recording medium). Consequently, it is possible to improve the thin paper separation property when an image by superimposition of a full-color toner is output and application performance with respect to a wide range of media can be obtained.

In addition, the present inventors have found out that there is a tendency in the yellow toner that the high temperature elasticity is likely to decrease as compared to other color toners (magenta toner and cyan toner) in the course of investigations, and they have further carried out investigations in order to cope with such a tendency, whereby the present invention has been completed. The mechanism is not clear, but it is presumed that this is because an effect (filler effect) of improving the high temperature elasticity of toner by the colorant particles contained in the toner is lower in the yellow toner as compared to other color toners.

In contrast, it is considered that a decrease in high temperature elasticity to be distinctive of the yellow toner is suppressed in the present invention by controlling the concentration of aluminum in the toner base particles of the yellow toner to be in a relation of Formula (1) and Formula (2) described above (or Formula (5) and Formula (6) described above) with respect to other color toners (magenta toner and cyan toner). Moreover, it is considered that an effect of further improving the thin paper separation property can be obtained by decreasing the difference in high temperature elasticity (color difference) between the yellow toner and other color toners. Formula (1) and Formula (2) described above (or Formula (5) and Formula (6) described above) define that the aluminum content in the yellow toner (Al (Y)) is 1.3 times or more and 5.0 times or less relative to each of the aluminum contents (Al (M) and Al (C)) in the magenta toner and the cyan toner. When Al (Y)/Al (M) or Al (Y)/Al (C) is less than 1.3 times, the manifestation of the ion crosslinking effect in the yellow toner is not sufficient and the resin elasticity decreases, and thus the difference in high temperature elasticity between the yellow toner and other color toners is remarkable and separation property of thin paper decreases. Alternatively, in a case in which the aluminum content in the yellow toner is relatively high, the ion crosslinking effect in the magenta toner and the cyan toner is excessive, and thus the low temperature fixability decreases. On the other hand, when Al (Y)/Al (M) or Al (Y)/Al (C) is higher than 5.0 times, the ion crosslinking effect in the yellow toner is excessive, and thus the low temperature fixability decreases.

Furthermore, it is considered that in the toner base particles, the binder resin further contains a crystalline resin in addition to an amorphous polyester resin as a main component and these resins are compatible to contribute to the improvement of low temperature fixability.

Incidentally, the mechanism described above is a presumption, and the present invention is not limited to the mechanism described above in any way.

Hereinafter, the configuration of the present invention will be described in detail. The image forming method and toner set according to the present invention are characterized by the respective color toners as described above. Hence, hereinafter, the configuration of the color toners will be first described in detail.

[Color Toner]

In the present specification, the respective color toners contain toner base particles containing a binder resin, a colorant corresponding to each color, and aluminum, respectively. The "toner" according to the present invention contains "toner base particles". The "toner base particles" are referred to as "toner particles" after the addition of an external additive. Moreover, the "toner" refers to an aggregate of the "toner particles".

<Toner Base Particles>

The toner base particles according to the present invention contain a binder resin, a colorant corresponding to each color, and aluminum at a specific concentration as described above. In addition, the toner base particles may contain other toner constitutional components such as a release agent and a charge control agent if necessary. Hereinafter, the respective components constituting the toner base particles will be described.

<<Aluminum>>

The toner base particles of the color toner according to the present invention contain aluminum at a concentration of from 300 to 1500 ppm. That is, the concentrations of aluminum (Al (Y), Al (M), and Al (C)) in the toner base particles of the respective color toners are all in a range of from 300 to 1500 ppm.

As described above, aluminum in the toner base particles is present as an aluminum ion and forms a crosslinked structure with an amorphous polyester resin (particularly, a remaining carboxyl group). At this time, the aluminum ion is present as a trivalent ion so as to have three bonding arms, and thus it can form a three-dimensional crosslinked structure. Consequently, it is presumed that the aluminum ion can sufficiently form a crosslinked structure as compared to a monovalent or divalent ion having one or two bonding arms so as to contribute to the improvement of elasticity of the toner base particles.

In this manner, in the present invention, sufficient crosslinked structures are formed as the toner base particles contain aluminum at the concentration described above. Moreover, by such a crosslinked structure, moderate elasticity is imparted to the toner base particles and it is possible to improve the thin paper separation property as well as the low temperature fixability is maintained. Furthermore, it is preferable that the concentrations of aluminum (Al (Y), Al (M), and Al (C)) in the toner base particles of the respective color toners are all from 400 to 1200 ppm in order to improve the effect of the present invention.

Furthermore, the aluminum concentration (Al (Y)) in the yellow toner is preferably from 800 to 1200 ppm and more preferably from 900 to 1200 ppm from the viewpoint of excellent low temperature fixability and of obtaining favorable thin paper separation property.

In addition, the aluminum concentrations (Al (M) and Al (C)) in the magenta toner and the cyan toner are preferably from 400 to 800 ppm and more preferably from 500 to 700 ppm from the viewpoint of improving thin paper separation property.

Consequently, from the above, an aspect in which Al (Y) is from 800 to 1200 ppm and Al (M) and Al (C) are from 400 to 800 ppm is preferable and an aspect in which Al (Y) is from 900 to 1200 ppm and Al (M) and Al (C) are from 500 to 700 ppm is even more preferable.

Furthermore, in the present invention, the concentrations of aluminum (Al (Y), Al (M) and Al (C)) in the toner base particles of the respective color toners satisfy the relation of Formula (1) and Formula (2) described above (or Formula (5) and Formula (6) described above). That is, the ratio (Al (Y)/Al (M)) of the aluminum concentration in the toner base particles of the yellow toner to the aluminum concentration in the toner base particles of the magenta toner and the ratio (Al (Y)/Al (C)) of the aluminum concentration in the toner base particles of the yellow toner to the aluminum concentration in the toner base particles of the cyan toner are all within a range of from 1.3 to 5.0.

As described above, it is possible to suppress a decrease in resin elasticity at a high temperature (high temperature elasticity) that is a distinctive tendency of the yellow toner by satisfying such a specific relation. As a result, it is possible to decrease the difference in high temperature elasticity between the yellow toner and other color (magenta and cyan) toners and to improve the thin paper separation property. In addition, it is possible to exert favorable low temperature fixability at the same time.

In the present invention, it is preferable that Al (Y), Al (M), and Al (C) further satisfy the following Formula (3) and Formula (4) from the viewpoint of obtaining excellent thin paper separation property together with the low temperature fixability in good balance.

[Numerical Formula 5]

$$1.5 \leq Al(Y)/Al(M) \leq 3.0 \ldots \quad (3)$$

$$1.5 \leq Al(Y)/Al(C) \leq 3.0 \ldots \quad (4)$$

That is, it is preferable that Al (Y)/Al (M) and Al (Y)/Al (C) are within a range of from 1.5 to 3.0. Furthermore, Al (Y)/Al (M) and Al (Y)/Al (C) are more preferably from 1.5 to 2.8, even more preferably from 1.6 to 2.8, and even more preferably from 1.7 to 2.5 from the viewpoint of more easily obtaining the effect described above.

The supply source of aluminum (supply source of aluminum ion) contained in the toner base particles is not particularly limited, and examples thereof may include a metal salt such as aluminum chloride, aluminum bromide, aluminum iodide, aluminum sulfate, or aluminum nitrate; and a polymer of an inorganic metal salt such as polyaluminum chloride or polyaluminum hydroxide. As the supply source of aluminum, one kind or more kinds selected from those described above can be used.

The method for producing the toner base particles containing aluminum is not particularly limited, and examples thereof may include a method in which the toner base particles are prepared by an emulsion aggregation method and a compound to be the supply source of aluminum described above is used as the aggregating agent at this time. Hence, it is preferable to use aluminum chloride, aluminum sulfate, polyaluminum chloride, and polyaluminum hydroxide as the supply source of aluminum in light of the utility as an aggregating agent.

In addition, the concentration of aluminum in the toner base particles can be controlled by appropriately adjusting the addition amount of the supply source of aluminum relative to the addition amount of the constitutional components of the toner base particles such as the binder resin.

<<Other Metals>>

The toner base particles to be used in the present invention may contain a metal other than aluminum described above as long as the effect of the present invention is not impaired. Examples of such a metal may include a metal derived from the aggregating agent to be used in the case of preparing the toner base particles by an emulsion aggregation method.

The aggregating agent is not particularly limited, and examples thereof may include a chloride or sulfate of a divalent metal. Hence, the toner base particles may contain a divalent metal derived from the aggregating agent described above. Specific examples of the aggregating agent may include magnesium chloride, magnesium sulfate, iron (II) chloride, iron(II) sulfate, calcium chloride, and calcium sulfate. Consequently, the toner base particles may further contain at least one selected from the group consisting of magnesium, iron, and calcium.

The concentration of the metal in the toner base particles is not particularly limited as long as the effect of the present invention is not impaired, and it is preferably 1000 ppm or less, more preferably 800 ppm or less, and even more preferably 500 ppm or less. It is possible to decrease the environmental dependency of the electric charge amount caused by high polarization of the toner base particles due to the metal when the concentration is in the range described above. Incidentally, it is preferable that the total concentration of these is in the above range in the case of containing two or more kinds of metals other than aluminum. On the other hand, the lower limit of the concentration of the metal is not particularly limited, but it is more preferable as the concentration of the metal is lower, and the lower limit of the concentration of the metal is preferably 0 ppm.

<<Colorant>>

The toner base particles of the color toner according to the present invention contain a colorant corresponding to each color in addition to aluminum and a binder resin.

(Yellow Colorant)

The yellow toner at least contains a binder resin, a yellow colorant, and aluminum.

The yellow colorant (pigment) is not particularly limited, and it is possible to use those that are appropriately selected from the compounds known in the related art, such as an azo-based pigment (a monoazo-based pigment, a disazo-based pigment, a condensed azo-based pigment, or the like) and a polycyclic pigment (an isoindoline-based pigment, an isoindolinone-based pigment, a threne-based pigment, an anthraquinone-based pigment, a quinophthalone-based pigment, or the like).

Among them, the yellow colorant preferably contains an azo-based pigment as a main component. It is possible to improve the brightness and color developing property of the yellow toner by containing an azo-based pigment. Furthermore, from such a viewpoint, the yellow colorant preferably contains a monoazo-based pigment as a main component. It is possible to particularly remarkably exert the effect of the present invention by using a yellow toner containing a monoazo-based pigment. Here, the "main component" means a colorant which has the highest content ratio among the colorants contained in the yellow toner. The monoazo-based pigment is preferably 70% by mass or more, more preferably 80% by mass or more, even more preferably 90% by mass or more, and even more preferably 100% by mass relative to the total amount of the yellow colorant.

The monoazo-based pigment is a compound having one azo group (—N═N—), and specific examples of such a monoazo-based pigment may include C.I. Pigment Yellow 1, C.I. Pigment Yellow 3, C.I. Pigment Yellow 65, C.I. Pigment Yellow 74, C.I. Pigment Yellow 98, and C.I. Pigment Yellow 111. Among them, the monoazo-based pigment is preferably at least one kind selected from C.I. Pigment Yellow 65, C.I. Pigment Yellow 74, C.I. Pigment Yellow 98, and C.I. Pigment Yellow 111 from the viewpoint of being able to remarkably manifesting the effect of the present invention.

A yellow colorant (pigment) other than the monoazo-based pigment may be concurrently used. Examples of the yellow colorant to be concurrently used may include an isoindoline compound, an isoindolinone compound, an anthraquinone compound, and an allylamide compound (which do not contain a monoazo group).

Such a compound is not particularly limited, and it is possible to use those that are appropriately selected from the yellow colorants (colorants for yellow or orange) known in the related art. Specific examples thereof may include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 151, C.I. Pigment Yellow 155, C.I. Pigment Yellow 180, and C.I. Pigment Yellow 185. These colorants (pigments) may be used singly or two or more kinds thereof may be concurrently used.

The content (the total amount in the case of containing two or more kinds) of the yellow colorant is preferably from 1 to 30 parts by mass and more preferably from 3 to 20 parts by mass relative to 100 parts by mass of the toner base particles from the viewpoint of effectively manifesting the effect of the present invention. In addition, the color reproducibility of an image can be secured when the content is in such a range.

(Magenta Colorant)

The magenta toner at least contains a binder resin, a magenta colorant, and aluminum.

The magenta colorant (pigment) is not particularly limited, and it is possible to use those that are appropriately selected from the compounds known in the related art, such as an azo-based pigment (an azo lake-based pigment, a monoazo-based pigment, a disazo-based pigment, a condensed azo-based pigment, or the like) and a polycyclic pigment (a quinacridone-based pigment, a perylene-based pigment or the like).

Examples of the magenta colorant (colorants for magenta or red) used in the magenta toner may include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48; 1, C.I. Pigment Red 53; 1, C.I. Pigment Red 57; 1, C.I. Pigment Red 122, C.I. Pigment Red 123, C.I. Pigment Red 139, C.I. Pigment Red 144, C.I. Pigment Red 149, C.I. Pigment Red 150, C.I. Pigment Red 166, C.I. Pigment Red 177, C.I. Pigment Red 178, C.I. Pigment Red 184, C.I. Pigment Red 222, C.I. Pigment Red 238, and C.I. Pigment Red 256. These colorants (pigments) may be used singly or two or more kinds thereof may be concurrently used.

The content (the total amount in the case of containing two or more kinds) of the magenta colorant is preferably from 1 to 30 parts by mass and more preferably from 3 to 20 parts by mass relative to 100 parts by mass of the toner base particles from the viewpoint of effectively manifesting the effect of the present invention. In addition, the color reproducibility of an image can be secured when the content is in such a range.

(Cyan Colorant)

The cyan toner at least contains a binder resin, a cyan colorant (pigment), and aluminum.

The cyan colorant (pigment) is not particularly limited, and it is possible to use those that are appropriately selected from the compounds known in the related art, such as a phthalocyanine-based pigment and a threne-based pigment.

Examples of the cyan colorant (colorants for green or cyan) used in the cyan toner may include C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66, and C.I. Pigment Green 7. These colorants (pigments) may be used singly or two or more kinds thereof may be concurrently used.

The content (the total amount in the case of containing two or more kinds) of the cyan colorant is preferably from 1 to 30 parts by mass and more preferably from 3 to 20 parts by mass relative to 100 parts by mass of the toner base particles from the viewpoint of effectively manifesting the effect of the present invention. In addition, the color reproducibility of an image can be secured when the content is in such a range.

(Size of Colorant Particles)

As the size of the colorant (particles) is not particularly limited, but it is preferably from 10 to 1000 nm, more preferably from 50 to 500 nm, and even more preferably from 80 to 300 nm as a volume average particle size. It is preferable that the size is in such a range since the colorant is suitable for the formation of a small-size toner required for high image quality as well as high color reproducibility can be obtained. Incidentally, the volume average particle size of the colorant (particles) can be measured, for example, by using the Microtrac particle size distribution measuring apparatus "UPA-150" (manufactured by NIKKISO CO., LTD.).

(Combination of Kinds of Colorants)

Regarding the kinds of colorants contained in the respective color toners, an embodiment in which the colorant of the yellow toner contains an azo-based pigment, the colorant of the magenta toner contains a polycyclic pigment, and the colorant of the cyan toner contains a phthalocyanine-based pigment is preferable in order to more remarkably obtain the effect of the present invention. The "azo-based pigment" is a compound having one or more azo groups. In addition, the "polycyclic pigment" is a compound having two or more cyclic structures (an aromatic ring and the like).

In the present invention, a particularly preferred embodiment is a form in which the colorant of the yellow toner contains a monoazo-based pigment, the colorant of the magenta toner contains a quinacridone-based pigment, and the colorant of the cyan toner contains a phthalocyanine-based pigment. It is possible to effectively exert particularly the effect of the present invention by having such a form.

<Binder Resin (Crystalline Resin and Amorphous Polyester Resin)>

The toner base particles of the color toner according to the present invention contain a binder resin in addition to aluminum and the colorant. The binder resin further contains a crystalline resin in addition to an amorphous polyester resin as a main component.

<<Amorphous Polyester Resin>>

The amorphous polyester resin is a resin constituting the binder resin together with the crystalline resin to be described in detail below, and it is a main component of the binder resin contained in the toner base particles. Here, the "main component" means a resin which has the highest content ratio in the binder resin contained in the toner. The amorphous polyester resin is preferably from 50 to 99% by mass and more preferably from 60 to 95% by mass relative to the total binder resin.

An amorphous polyester resin is a polyester resin, and it is a resin which does not have a melting point but has a relatively high glass transition temperature (Tg) when being subjected to differential scanning calorimetry (DSC). The glass transition temperature (Tg) of an amorphous polyester resin is preferably from 30 to 80° C. and even more preferably from 40 to 64° C. Incidentally, the glass transition temperature (Tg) can be measured by using a differential scanning calorimeter (DSC), and specifically it is measured by the method described in Examples. In addition, the monomer constituting the amorphous polyester resin is different from the monomer constituting the crystalline polyester resin, and thus the crystalline polyester resin can be distinguished from the amorphous polyester resin, for example, by analysis such as NMR. In addition, the glass transition temperature can be controlled by the composition of the resin by those skilled in the art.

The amorphous polyester resin is obtained by the polycondensation reaction of a di- or higher carboxylic acid (polycarboxylic acid) and a dihydric or higher alcohol (a polyhydric alcohol). The amorphous polyester resin is not particularly limited, and an amorphous polyester resin that is known in the related art in this technical field can be used.

The examples of the polycarboxylic acid and polyhydric alcohol to be used in the preparation of the amorphous polyester resin are not particularly limited but may include the following monomers.

(Polycarboxylic Acid)

As the polycarboxylic acid, it is preferable to use an unsaturated aliphatic polycarboxylic acid, an aromatic polycarboxylic acid, and any derivative thereof. A saturated aliphatic polycarboxylic acid may be concurrently used as long as an amorphous resin can be formed.

Examples of the unsaturated aliphatic polycarboxylic acid may include an unsaturated aliphatic dicarboxylic acid such as methylenesuccinic acid, fumaric acid, maleic acid, 3-hexenedioic acid, 3-octenedioic acid, or succinic acid substituted with an alkyl group having from 1 to 20 carbon atom(s) or an alkenyl group having from 2 or 20 carbon atoms: an unsaturated aliphatic tricarboxylic acid such as 3-butene-1,2,3-tricarboxylic acid, 4-pentene 1,2,4-tricarboxylic acid, or aconitic acid; and an unsaturated aliphatic tetracarboxylic acid such as 4-pentene-1,2,3,4-tetracarboxylic acid, and it is also possible to use any lower alkyl ester or acid anhydride thereof.

Examples of the aromatic polycarboxylic acid may include an aromatic dicarboxylic acid such as phthalic acid, terephthalic acid, isophthalic acid, t-butylisophthalic acid, tetrachlorophthalic acid, chlorophthalic acid, nitrophthalic acid, p-phenylenediacetic acid, 2,6-naphthalenedicarboxylic acid, 4,4'-biphenyldicarboxylic acid, or anthracenedicarboxylic acid; an aromatic tricarboxylic acid such as 1,2,4-benzenetricarboxylic acid (trimellitic acid), 1,2,5-benzenetricarboxylic acid (trimesic acid), 1,2,4-naphthalenetricarboxylic acid, or hemimellitic acid; an aromatic tetracarboxylic acid such as pyromellitic acid or 1,2,3,4-butanetetracarboxylic acid; and an aromatic hexacarboxylic acid such as mellitic acid, and it is also possible to use any lower alkyl ester or acid anhydride thereof.

The polycarboxylic acids may be used singly or as a mixture of two or more kinds thereof.

(Polyhydric Alcohol)

As the polyhydric alcohol, it is preferable to use an unsaturated aliphatic polyhydric alcohol, an aromatic polyhydric alcohol, and any derivative thereof from the viewpoint of electrification property or toner strength, and a saturated aliphatic polyhydric alcohol may be concurrently used as long as an amorphous resin can be formed.

Examples of the unsaturated aliphatic polyhydric alcohol may include an unsaturated aliphatic diol such as 2-butene-1,4-diol, 3-butene-1,4-diol, 2-butyne-1,4-diol, 3-butyne-1,4-diol, or 9-octadecene-7,12-diol, and it is also possible to use any derivative thereof.

Examples of the aromatic polyhydric alcohol may include bisphenols such as bisphenol A and bisphenol F and an alkylene oxide adducts of bisphenols such as an ethylene oxide adduct and a propylene oxide adduct thereof, 1,3,5-benzenetriol, 1,2,4-benzenetriol, and 1,3,5-trihydroxy methyl benzene, and it is also possible to use any derivative thereof. Among these, it is preferable to use a bisphenol A compound such as an ethylene oxide adduct and a propylene oxide adduct of bisphenol A particularly from the viewpoint of easily optimizing the thermal property.

In addition, the number of carbon atoms in the trihydric or higher polyhydric alcohol is not particularly limited, but the number of carbon atoms is preferably from 3 to 20 particularly since the thermal property is easily optimized.

The polyhydric alcohols described above may be used singly or as a mixture of two or more kinds thereof.

The method for producing the amorphous polyester resin is not particularly limited, and the resin can be produced by the polycondensation (esterification) of the polycarboxylic acid and the polyhydric alcohol using a known esterification catalyst.

Examples of the catalyst which can be used in the production may include a compound of an alkali metal such as sodium or lithium; a compound containing a Group 2 element such as magnesium or calcium; a compound of a metal such as aluminum, zinc, manganese, antimony, titanium, tin, zirconium, or germanium; a phosphorous acid compound; a phosphoric acid compound; and an amine compound. It is preferable to use dibutyltin oxide, tin octylate, tin dioctoate, any salt thereof, or tetra-n-butyl titanate (tetrabutyl orthotitanate), tetraisopropyl titanate (titanium tetraisopropoxide), tetramethyl titanate, and the like in light of easy availability and the like. These may be used singly or in combination of two or more kinds thereof.

The temperature for polycondensation (esterification) is not particularly limited, but it is preferably from 150 to 250° C. In addition, the time for polycondensation (esterification) is not particularly limited, but it is preferably from 0.5 to 15 hours. The reaction mixture may be under reduced pressure during the polycondensation if necessary.

In addition, the amorphous polyester resin may be an amorphous vinyl modified polyester resin having a block copolymer structure in which a vinyl polymerized segment (vinyl resin segment) is chemically bonded to the amorphous polyester polymerized segment composed of the polycarboxylic acid and polyhydric alcohol described above.

Examples of such an amorphous vinyl modified polyester resin may preferably include an amorphous styrene-acrylic modified polyester resin. Here, the "styrene-acrylic modified polyester resin" refers to a resin constituted by a polyester molecule having a block copolymer structure in which a styrene-acrylic copolymer molecular chain (styrene-acrylic polymerized segment) is chemically bonded to an amorphous polyester molecular chain (amorphous polyester polymerized segment).

Hereinafter, the styrene-acrylic modified polyester resin that is preferable as the amorphous vinyl modified polyester resin will be described.

(Styrene-Acrylic Modified Polyester Resin)

A styrene-acrylic modified polyester resin refers to a resin constituted by a polyester molecule having a block copolymer structure in which an amorphous polyester polymerized segment (amorphous polyester resin segment) and a styrene-acrylic polymerized segment (styrene-acrylic copolymer segment) are chemically bonded to each. The styrene-acrylic modified polyester resin may be used singly or two or more kinds thereof may be concurrently used.

The method for forming the amorphous polyester polymerized segment is not particularly limited. The specific kinds of the polycarboxylic acid and polyhydric alcohol to be used in the formation of the amorphous polyester polymerized segment and the conditions for the polycondensation of these monomers are the same as those described above, and thus the description thereon is omitted here.

Meanwhile, the styrene-acrylic polymerized segment constituting the styrene-acrylic modified polyester resin is the segment that is formed by the addition polymerization of a styrene monomer and a (meth)acrylic acid ester monomer. The styrene monomer and (meth)acrylic acid ester monomer to be used are not particularly limited, and for example, one kind or more kinds selected from those to be described below can be used.

Styrene Monomer

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, any derivative thereof, and the like.

(Meth)Acrylic Acid Ester Monomer

Methyl (meth)acrylate, ethyl (meth)acrylate, n-butyl (meth)acrylate, isopropyl (meth)acrylate, isobutyl (meth) acrylate, t-butyl (meth)acrylate, n-octyl (meth)acrylate, 2-ethylhexyl (meth)acrylate, n-stearyl (meth)acrylate, lauryl (meth)acrylate, phenyl (meth)acrylate, diethylaminoethyl (meth)acrylate, dimethylaminoethyl (meth)acrylate, any derivative thereof, and the like.

Incidentally, in the present specification, the term "(meth) acrylic acid" includes both acrylic acid and methacrylic acid.

The styrene-acrylic polymerized segment may be formed by using further the following monomers in addition to the monomers described above.

Vinyl Esters

Vinyl propionate, vinyl acetate, vinyl benzoate, and the like.

Vinyl Ethers

Vinyl methyl ether, vinyl ethyl ether, and the like.

Vinyl Ketones

Vinyl methyl ketone, vinyl ethyl ketone, vinyl hexyl ketone, and the like.

N-Vinyl Compounds

N-vinylcarbazole, N-vinylindole, and N-vinylpyrrolidone, and the like.

Others

Vinyl compounds such as vinylnaphthalene and vinylpyridine, acrylonitrile, methacrylonitrile, any derivative of acrylic acid or methacrylic acid such as acrylamide, and the like.

The method for forming the styrene-acrylic polymerized segment is not particularly limited, and examples thereof may include a method to conduct the polymerization by using an arbitrary polymerization initiator such as a peroxide, a persulfide, a persulfate, or an azo compound which is usually used in the polymerization of the monomer described above by a known polymerization technique such as bulk polymerization, solution polymerization, emulsion polymerization, miniemulsion method, or dispersion polymerization.

The content ratio of the amorphous polyester polymerized segment in the styrene-acrylic modified polyester resin is not particularly limited, but it is preferably from 60 to 95% by mass and more preferably from 70 to 95% by mass.

The content ratio (hereinafter, also referred to as the "styrene-acrylic modification rate") of the styrene-acrylic polymerized segment in the styrene-acrylic modified polyester resin is not particularly limited, but it is preferably from 5 to 40% by mass and more preferably from 5 to 30% by mass in total.

The styrene-acrylic modification rate specifically refers to the rate of the mass of the styrene monomer and (meth) acrylate monomer relative to the total mass of the resin materials to be used for synthesizing the styrene-acrylic modified polyester resin, namely, the total mass of the monomer constituting the unmodified amorphous polyester resin to form the amorphous polyester polymerized segment, the styrene monomer and (meth)acrylic acid ester monomer to form the styrene-acrylic polymerized segment, and the bireactive monomer for bonding these segments.

Here, the "bireactive monomer" refers to a monomer which bonds the styrene-acrylic polymerized segment with the amorphous polyester polymerized segment, and it is a monomer which has both of a group selected from a hydroxyl group, a carboxyl group, an epoxy group, a primary amino group, and a secondary amino group to form the amorphous polyester polymerized segment and an ethylenically unsaturated group to form the vinyl polymerized segment in the molecule.

Specific examples of the bireactive monomer may include acrylic acid, methacrylic acid, fumaric acid, and maleic acid, further, the bireactive monomer may be any hydroxyalkyl ester (having from 1 to 3 carbon atoms) of these. Among these, acrylic acid, methacrylic acid or fumaric acid is preferable from the viewpoint of reactivity. The styrene-acrylic polymerized segment and the amorphous polyester polymerized segment and bonded with each other via this bireactive monomer.

The amount of the bireactive monomer used is preferably from 1 to 20% by mass and more preferably from 4 to 15% by mass relative to 100% by mass of the total amount of the monomers constituting the styrene-acrylic polymerized segment from the viewpoint of improving the low temperature fixability.

The method for producing the styrene-acrylic modified polyester resin is not particularly limited as long as it is a method capable of forming a polymer having a structure in which the amorphous polyester polymerized segment is chemically bonded with the styrene-acrylic polymerized segment. Specific examples of the method for producing the styrene-acrylic modified polyester resin may include the methods to be described below.

(A) A method in which an amorphous polyester polymerized segment is formed in advance by polymerization, a bireactive monomer is reacted with the amorphous polyester polymerized segment, further an aromatic vinyl monomer and a (meth)acrylic acid ester monomer for forming a styrene-acrylic polymerized segment are reacted therewith to form the styrene-acrylic polymerized segment;

(B) a method in which a styrene-acrylic polymerized segment is formed in advance by polymerization, a bireactive monomer is reacted with the styrene-acrylic polymerized segment, further, a polycarboxylic acid and a polyhydric alcohol for forming an amorphous polyester polymerized segment are reacted therewith to form the polyester segment; and (C) a method in which an amorphous polyester polymerized segment and a styrene-acrylic polymerized segment are formed respectively in advance by polymerization, and a bireactive monomer is reacted with these segments to bond these two to each other.

Among the forming methods of (A) to (C) described above, the method of (A) is preferable from the viewpoint of being able to simplify the production process.

The weight average molecular weight (Mw) of the amorphous polyester resin (styrene-acryl modified polyester resin) is not particularly limited, but it is preferably within a range of from 5,000 to 100,000 and more preferably within a range of from 5,000 to 50,000. The weight average molecular weight (Mw) can be measured by gel permeation chromatography (GPC), and specifically it is measured by the method described in Examples. It is possible to improve the heat-resistant storage property of the toner when the weight average molecular weight is 5,000 or more, and it is possible to further improve the low temperature fixability when the weight average molecular weight is 100,000 or less.

<<Crystalline Resin>>

The binder resin contains a crystalline resin together with the amorphous polyester resin. Consequently, it is possible to improve the low temperature fixability as these resins are compatible at the time of being heated and fixed. The crystalline resin is not particularly limited as long as it is a resin exhibiting crystallinity, and it is possible to use a crystalline resin that is known in the related art in this technical field. Specific examples thereof may include a crystalline polyester resin, a crystalline polyurethane resin, a crystalline polyurea resin, a crystalline polyamide resin, and a crystalline polyether resin. The crystalline resin may be used singly or in combination of two or more kinds thereof.

Among them, the crystalline resin is preferably a crystalline polyester resin. The crystalline polyester resin exhibits favorable dispersibility in the amorphous polyester resin, and it can further improve the low temperature fixability. In addition, the crystalline polyester resin is likely to forma crosslinked structure with aluminum contained in the toner base particles so as to have an advantage that the high temperature elasticity is likely to be maintained while the low temperature fixability is secured.

A crystalline polyester resin is a polyester resin and it refers to a resin which has a clear endothermic peak but not a stepwise endothermic change in differential scanning calorimetry (DSC). The clear endothermic peak specifically means a peak which has a half value width of the endothermic peak of 15° C. or less when it is measured at a temperature rising rate of 10° C./min in differential scanning calorimetry (DSC).

The melting point (Tc) of the crystalline resin is preferably from 55 to 90° C. and more preferably from 70 to 88° C. Sufficient low temperature fixability can be obtained when the melting point of the crystalline resin is within a range of from 55 to 90° C. Incidentally, the melting point of the crystalline resin can be controlled by the resin composition. The melting point (Tc) of the crystalline resin can be measured by using a differential scanning calorimeter (DSC), and specifically it is measured by the method described in Examples. In addition, it is possible to control the melting point by the composition of the resin by those skilled in the art.

The crystalline polyester resin is obtained by the polycondensation reaction of a di- or higher carboxylic acid (polycarboxylic acid) with a dihydric or higher alcohol (polyhydric alcohol). The crystalline polyester resin is not particularly limited, and it is possible to use a crystalline polyester resin that is known in the related art in this technical field.

Examples of the polycarboxylic acid and polyhydric alcohol to be used in the preparation of the crystalline polyester resin are not particularly limited but may include the following monomers.

(Polycarboxylic Acid)

Examples of the polycarboxylic acid may include a saturated aliphatic dicarboxylic acid such as oxalic acid, malonic acid, succinic acid, adipic acid, pimelic acid, sebacic acid, azelaic acid, n-dodecylsuccinic acid, 1,9-nonanedicarboxylic acid, 1,10-decanedicarboxylic acid (dodecanedioic acid), 1,11-undecanedicarboxylic acid, 1,12-dodecanedicarboxylic acid (tetradecanedioic acid), 1,13-tridecanedicarboxylic acid, or 1,14-tetradecanedicarboxylic acid; and an alicyclic dicarboxylic acid such as cyclohexanedicarboxylic acid. In addition, a polycarboxylic acid other than a dicarboxylic acid may also be used. Furthermore, it is also possible to use any lower alkyl ester or acid anhydride thereof. The polycarboxylic acids may be used singly or as a mixture of two or more kinds thereof.

(Polyhydric Alcohol)

Examples of the polyhydric alcohol may include an aliphatic diol such as ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, neopentyl glycol, or 1,4-butenediol. In addition, examples of the polyol other than the dihydric polyol may include a trihydric or higher polyhydric alcohol such as glycerin, pentaerythritol, trimethylol propane, or sorbitol. In addition, any derivative thereof may be used. The polyhydric alcohols may be used singly or in combination of two or more kinds thereof.

In addition, the polycarboxylic acid and the polyhydric alcohol may be partly branched or crosslinked depending on the selection of the valence thereof, and the like.

The method for forming the crystalline polyester resin using the monomers described above is not particularly limited, and the resin can be formed by the polycondensation (esterification) of the polycarboxylic acid with the polyhydric alcohol utilizing a known esterification catalyst. Specifically, the catalyst or conditions for polycondensation described in the section for <<Amorphous polyester resin>> described above can be applied.

In addition, the crystalline polyester resin is preferably a hybrid crystalline resin having a graft copolymer structure in which a crystalline polyester polymerized segment (crystalline polyester resin segment) composed of the polycarboxylic acid and the polyhydric alcohol is chemically bonded to a polymerized segment other than the crystalline resin (resin segment other than the crystalline resin). The compatibility of the crystalline polyester resin with the amorphous polyester resin is enhanced when the crystalline polyester resin is such a resin, and thus the low temperature fixability is improved.

Hereinafter, the hybrid crystalline resin will be described.

(Hybrid Crystalline Resin)

A hybrid crystalline resin refers to a resin in which a crystalline polyester polymerized segment and a polymerized segment other than the crystalline resin are chemically bonded with each other. The hybrid crystalline resin may be used singly or two or more kinds thereof may be concurrently used.

The method for forming the crystalline polyester polymerized segment is not particularly limited. The specific kinds of the polycarboxylic acid and polyhydric alcohol to be used in the formation of the crystalline polyester polymerized segment and the conditions for the polycondensation of these monomers are the same as those described above, and thus the description thereon is omitted here.

Meanwhile, the polymerized segment other than the crystalline resin refers to a moiety (molecular chain) derived from a resin other than the crystalline resin. Examples of the resin other than the crystalline resin may include a vinyl resin such as a styrene-acrylic resin, a urethane resin, and a urea resin. The polymerized segment other than the crystalline resin may be a single resin or a combination of two or more kinds.

Among those described above, the polymerized segment other than the crystalline resin is preferably a vinyl polymerized segment. That is, the crystalline resin is preferably a crystalline resin in which a crystalline polyester polymerized segment and a vinyl polymerized segment are chemically bonded with each other.

The vinyl polymerized segment in the hybrid crystalline resin is more preferably a styrene-acrylic polymerized segment from the viewpoint of enhancing the compatibility of the hybrid crystalline resin with the styrene-acrylic modified polyester resin that is preferably used as the amorphous polyester resin and improving the low temperature fixability.

The method for forming the styrene-acrylic polymerized segment is not particularly limited. The specific kinds and polymerization method of the monomers to be used for forming the styrene-acrylic polymerized segment are the same as those described in the section for (styrene-acryl modified polyester resin) in <<amorphous polyester resin>> described above, and thus the description thereon is omitted here.

The content ratio of the crystalline polyester polymerized segment in the hybrid crystalline resin is not particularly limited, and it is preferably from 70 to 95% by mass and more preferably from 80 to 95% by mass. It is possible to improve the low temperature fixability when content ratio is in such a range.

The content ratio (hereinafter, also referred to as the "hybridization rate") of the styrene-acrylic polymerized segment in the hybrid crystalline resin is not particularly limited, but it is preferably from 5 to 30% by mass and more preferably from 5 to 20% by mass in total.

The hybridization rate refers to the rate of the mass of the styrene monomer and (meth)acrylate monomer relative to the total mass of the resin materials to be used for synthesizing the hybrid crystalline resin, namely, the total mass of the monomer constituting the unmodified crystalline polyester resin to form the crystalline polyester polymerized segment, the styrene monomer and (meth)acrylic acid ester monomer to form the styrene-acrylic polymer segment, and the bireactive monomer for bonding these segments.

Here, the bireactive monomer is the same as that described in the section for (styrene-acryl modified polyester resin) in <<Amorphous polyester resin>> described above, and thus the description thereon is omitted here.

The hybrid crystalline resin is preferably a graft copolymer having a styrene-acrylic polymerized segment as a backbone and a crystalline polyester polymerized segment as a branch, and these segments are preferably bonded with each other via a bireactive monomer. By adopting such a form, it is easy to control the orientation of the crystalline polyester polymerized segment and it is possible to impart sufficient crystallinity to the hybrid crystalline resin and to improve the low temperature fixability of the toner.

The amount of the bireactive monomer used is preferably from 1 to 15% by mass and more preferably from 3 to 10% by mass relative to 100% by mass of the total amount of the monomers constituting the styrene-acrylic polymerized segment from the viewpoint of improving the low temperature fixability of the toner.

As the method for producing the hybrid crystalline resin, it is possible to use an existing general scheme. Examples of the typical method may include the methods in which the amorphous polyester polymerized segment is changed to the crystalline polyester polymerized segment in the respective methods of (A) to (C) mentioned in the section for (styrene-acryl modified polyester resin) in <<Amorphous polyester resin>> described above.

As the method for producing the hybrid crystalline resin, it is possible to use any of the methods of (A) to (C) described above, but preferably, the method of (B) described above is preferable. Specifically, the following method is preferable. First, a polycarboxylic acid and a polyhydric alcohol which form a crystalline polyester polymerized segment, a vinyl monomer (aromatic vinyl monomer and (meth)acrylic acid ester monomer) which forms a styrene-acrylic polymerized segment, and a bireactive monomer are mixed, then, a polymerization initiator is added to the monomer mixture in order to conduct the addition polymerization of the vinyl monomer with the bireactive monomer so as to forma styrene-acrylic polymerized segment. Subsequently, an esterification catalyst is added to conduct the polycondensation reaction.

The number average molecular weight (Mn) of the crystalline resin (hybrid crystalline resin) is not particularly limited, but it is preferably within a range of from 1,500 to 25,000 and more preferably within a range of from 3,000 to 20,000. It is possible to further improve the low temperature fixability when the number average molecular weight is within such a range. The number average molecular weight (Mn) can be measured by gel permeation chromatography (GPC), and specifically it is measured by the method described in Examples.

The content of the crystalline resin (hybrid crystalline resin) is preferably from 1 to 50% by mass and more preferably from 5 to 40% by mass relative to the total binder resin. When the content of the crystalline resin is 1% by mass or more, the crystalline resin is moderately plasticized by being compatible with the amorphous polyester resin, and the effect of low temperature fixability is likely to be exerted. Meanwhile, when the content of the crystalline resin is 50% by mass or less, the plasticization is moderately suppressed, and thus the offset in the high temperature fixing region is suppressed and thin paper separation property is improved.

Incidentally, the binder resin may contain another amorphous resin such as a vinyl resin in addition to the amorphous polyester resin and crystalline resin described above. The content of another amorphous resin is preferably 30% by mass or less relative to the total binder resin, and it is more preferable that the content is 0% by mass, that is, another amorphous resin is not contained.

<<Release Agent>>

The toner base particles of the color toner to be used in the present invention may contain a release agent (wax) if necessary.

Examples of the release agent may include a hydrocarbon-based wax such as low molecular weight polyethylene wax, low molecular weight polypropylene wax, Fischer-Tropsch wax, microcrystalline wax, or paraffin wax and an ester wax such as carnauba wax, pentaerythritol behenate, behenyl behenate, or behenyl citrate. These may be used singly or in combination of two or more kinds thereof.

The content ratio of the release agent is preferably from 2 to 20% by mass, more preferably from 3 to 18% by mass, and even more preferably from 4 to 15% by mass relative to the total amount of the binder resin.

In addition, the melting point of the release agent is preferably from 50 to 95° C. from the viewpoint of low temperature fixability and mold release property of the toner in electrophotography.

<<Charge Control Agent>>

The toner base particles of the color toner to be used in the present invention may contain another internal additive if necessary. Examples of such an internal additive may include a charge control agent. Examples of the charge control agent may include a metal complex (metal complex of salicylic acid) of a salicylic acid derivative and zinc or aluminum, a calixarene compound, an organic boron compound, and a fluorine-containing quaternary ammonium salt compound.

The content ratio of the charge control agent is usually preferably from 0.1 to 10 parts by mass and more preferably from 0.5 to 5 parts by mass relative to 100 parts by mass of the binder resin in the toner.

<<Form of Toner Base Particles>>

The toner base particles may have a so-called single-layer structure or have a core-shell structure (a form in which a resin forming the shell layer is aggregated and fused on the surface of the core particles). The toner base particles having the core-shell structure preferably have a resin region (shell layer) having a relatively high glass transition temperature on the surface of resin particles (core particles) which contain a colorant, a release agent, or the like and have a relatively low glass transition temperature. The core-shell structure is not limited to the structure in which the shell layer completely covers the core particles, and it also includes those in which the shell layer does not completely cover the core particles but some sites of the core particles are exposed, for example.

The cross-sectional structure of such a core-shell structure can be confirmed, for example, by using a known means such as a transmission electron microscope (TEM) or a scanning probe microscope (SPM).

The resins constituting the core particles and the shell layer are not particularly limited as long as they satisfy the property related to the glass transition temperature described above.

(Core Particles)

As the binder resin constituting the core particles is not particularly limited, and for example, it is possible to use the amorphous polyester resin, the crystalline resin, and the like which are described above. As these resins, one kind or more kinds selected from those described above can be used. Among them, the core particles preferably contain the styrene-acrylic modified polyester resin as the amorphous polyester resin and the hybrid crystalline resin as the crystalline resin in light of the electrification property and the like.

(Shell Layer)

The binder resin constituting the shell layer is not particularly limited, but for example, the amorphous polyester resin and the like described above are used. As these resins, one kind or more kinds selected from those described above can be used. Among them, the shell layer preferably contains the styrene-acrylic modified polyester resin.

The amorphous polyester resin contained in the core particles and the amorphous polyester resin contained in the shell layer can be ionically crosslinked via aluminum as the toner base particles of the color toner according to the present invention contain aluminum at the specific concentration described above. Hence, a crosslinked structure is firmly formed at the interface between the core particle and the shell layer, and thus it is easier to form an ideal core-shell structure. As a result, the heat resistance is improved, and further the low temperature fixability is improved in association with this. In addition, the fracture of the toner particles is suppressed even when being stirred in the developing device so as to be exposed to stress since the shell layer is not easily peeled off. As a result, an image which has a high image quality but does not have an image noise is obtained, for example, even when a high-function machine such as a high-speed machine is used.

In a case in which the core particles contain the styrene-acrylic modified polyester resin as described above, the affinity between the shell layer and the core particles is enhanced by using the styrene-acrylic modified polyester resin in the shell layer. This further promotes the effect described above.

The content of the core particles is preferably from 50 to 95% by mass and more preferably from 60 to 90% by mass relative to the total resin amount (total amount of binder resin) of the core particles and the shell layer. In addition, the content of the shell layer is preferably from 5 to 50% by mass and more preferably from 10 to 40% by mass relative to the total resin amount (total amount of binder resin) of the core particles and the shell layer. It is possible to further improve the low temperature fixability and the thin paper separation property when the content ratio of the resin for shell and the resin for core in the binder resin in the toner base particles are within the above ranges.

<<Average Circularity of Toner Base Particles>>

The average circularity of the toner base particles is preferably from 0.920 to 1.000 and more preferably from 0.940 to 0.995 from the viewpoint of improving the low temperature fixability. Here, the average circularity is the value measured by using the "FPIA-2100" (manufactured by Sysmex Corporation).

Specifically, the toner base particles are wetted in an aqueous solution of a surfactant, subjected to the ultrasonic dispersion for 1 minute to be dispersed, and subjected to the measurement at a proper concentration having a HPF detection number of 4000 by using the "FPIA-2100" under the measurement conditions of a HPF (high magnification imaging) mode. The circularity is calculated by the following formula.

Circularity=(circumferential length of a circle having an equivalent to a projected area of a particle image)/(circumferential length of a projected image of a particle)

In addition, the average circularity is the arithmetic mean value obtained by summing the circularities of the respective particles and dividing the sum by the total number of particles measured.

<<Particle Size of Toner Base Particles>>

The particle size of the toner base particles is preferably from 3 to 10 μm as the volume-based median diameter (D50). By controlling the volume-based median diameter to be in the above range, it is possible to cut down the consumption amount of toner as compared to the case of using a toner having a greater particle size as well as it is possible to achieve the reproducibility of a thin line or the high image quality of a photographic image. In addition, the fluidity of toner can be secured. Here, the volume-based median diameter (D50) of the toner base particles can be measured and calculated, for example, by using an apparatus prepared by connecting the computer system for data processing to the "Multisizer 3 (manufactured by Beckman Coulter, Inc.)".

The volume-based median diameter of the toner can be controlled by the concentration of the aggregating agent, the addition amount of the solvent, or the fusion time in the aggregation and fusion step at the time of producing the toner to be described later and further by the composition or the like of the resin component.

<External Additive>

The toner base particles can be used as toner particles as they are, but it is preferable to add known particles such as inorganic particles or organic particles, a lubricant, and the like to the surface of the toner base particles as an external additive from the viewpoint of improving the electrification performance or fluidity as a toner or cleaning property. As the external additive, various ones may be used in combination. Examples of the particles may include inorganic oxide particles such as silica particles, alumina particles, and titania particles, particles of an inorganic stearic acid compound such as aluminum stearate particles or zinc stearate fine particles, or particles of an inorganic titanate compound such as strontium titanate particles or zinc titanate particles. In addition, examples of the lubricant may include metal salts of higher fatty acids such as zinc, aluminum, copper, magnesium, and calcium salts of stearic acid, zinc, manganese, iron, copper, and magnesium salts of oleic acid, zinc, copper, magnesium, and calcium salts of palmitic acid, zinc and calcium salts of linoleic acid, and zinc and calcium salts of ricinoleic acid. These external additives may be subjected to the surface treatment by a silane coupling agent or a titanium coupling agent, a higher fatty acid, silicone oil, or the like from the viewpoint of heat-resistant storage property and environmental stability.

The addition amount (total amount in the case of using two or more kinds) of these external additives is preferably from 0.05 to 5 parts by mass relative to 100 parts by mass of the toner base particles.

Among the above, inorganic oxide particles such as silica particles (spherical silica), alumina particles, and titania particles are preferably used as the external additive. At this time, it is particularly preferable to use silica particles having a number average primary particle size of from 60 to 150 nm. Such silica particles have a relatively great size and can exert a high spacer effect. Hence, the silica particles can suppress the embedding or movement of not only themselves but also other external additives including titania particles. As a result, it is possible to suppress a decrease in electric charge amount due to the deterioration of the toner under high stress in a low coverage mass print or the like and further a decrease in image quality of an output image associated therewith.

Incidentally, the number average primary particle size of the external additive particles can be calculated from an electron micrograph. In the present specification, the "number average primary particle size" is the value calculated by the following procedure.

(1) A photograph of the toner is taken at a magnification of 30,000-fold by a scanning electron microscope, and this photographic image is captured by a scanner; and (2) The external additive particles (titania particles, silica particles, and the like) present on the surface of the toner in the photographic image are subjected to the binary coded processing by the image processing analysis apparatus "LUZEX AP (manufactured by Nireco Corporation)", the horizontal Feret's diameter is calculated for 10,000 particles, and the average thereof is adopted as the number average primary particle size.

[Method for Producing Color Toner]

Hereinafter, a method for producing a color toner to be used in the present invention will be described.

The method for producing the color toner is not particularly limited, and examples thereof may include known methods such as a kneading pulverization method, a suspension polymerization method, an emulsion aggregation method, a dissolution suspension method, a polyester extension method, and a dispersion polymerization method.

Among these, it is preferable to employ an emulsion aggregation method from the viewpoint of uniformity of the particle size, controllability of the shape, and easiness of formation of the core-shell structure. Hereinafter, the emulsion aggregation method will be described.

<Emulsion Aggregation Method>

The emulsion aggregation method is a method to form toner base particles by mixing a dispersion of particles of the binder resin (hereinafter, also referred to as the "binder resin particles") dispersed by using a surfactant or a dispersion stabilizer with a dispersion of particles of a colorant (hereinafter, also referred to as the "colorant particles"), aggregating the particles until to have a desired particle size, and further conducting the fusion among the binder resin particles to control the shape. Here, the particles of the binder resin may arbitrarily contain a release agent, a charge control agent, and the like.

In the case of producing the color toner by the emulsion aggregation method, the method for producing the toner according to a preferred embodiment includes (a) a step (hereinafter, also referred to as the preparation step) of preparing a dispersion of crystalline resin particles, a dispersion of amorphous polyester resin particles, and a dispersion of colorant particles, (b) a step (hereinafter, also referred to as the step of aggregating and fusing core particles) of mixing, aggregating, fusing the dispersion of crystalline resin particles, the dispersion of amorphous polyester resin particles, and the dispersion of colorant particles, and (c) a step (hereinafter, also referred to as the step of forming shell layer) of adding a dispersion of amorphous polyester resin particles to the dispersion containing the core particles and aggregating and fusing the amorphous polyester resin on the surface of the core particles to form a shell layer.

Hereinafter, the respective steps (a) to (c) and the respective steps (d) to (f) that are arbitrarily conducted other than these steps (a) to (c) will be described in detail.

(a) Preparation Step

The step (a) includes a step of preparing a dispersion of crystalline resin particles, a step of preparing a dispersion of amorphous polyester resin particles, and a step of preparing a dispersion of colorant particles, and the step (a) also includes a step of preparing a dispersion of release agent particles if necessary.

(a-1) Step of Preparing Dispersion of Crystalline Resin Particles

The step of preparing a dispersion of crystalline resin particles is a step to prepare a dispersion of crystalline resin particles by synthesizing a crystalline resin constituting the toner base particles and dispersing this crystalline resin in an aqueous medium in the form of fine particles.

The method for producing the crystalline resin is as described above, and thus the description thereon is omitted here.

Examples of the method for preparing the dispersion of crystalline resin particles may include a method in which the dispersion treatment is conducted in an aqueous medium without using a solvent or a method in which the crystalline resin is dissolved in a solvent such as ethyl acetate or methyl ethyl ketone to form a solution, the solution is emulsified and dispersed in an aqueous medium by using a disperser, and the solvent removal treatment is then conducted.

In the present invention, the term "aqueous medium" refers to the medium that contains water at least at 50% by mass or more, examples of the components other than water may include an organic solvent which dissolves in water, and examples thereof may include methanol, ethanol, isopropanol, acetone, dimethylformamide, methyl cellosolve, and tetrahydrofuran. Among these, it is preferable to use an alcohol-based organic solvent of an organic solvent which does not dissolve the resin, such as methanol, ethanol, or isopropanol. Preferably, only water is used as the aqueous medium.

In a case in which the crystalline resin contains a carboxyl group in its structure, ammonia, sodium hydroxide, and the like may be added in order to smoothly advance the emulsification by dissociating the carboxyl group into ions and stably emulsifying the crystalline resin in the aqueous phase. Furthermore, a dispersion stabilizer may be dissolved in the aqueous medium, or a surfactant or resin particles may be added into the aqueous medium for the purpose of improving the dispersion stability of the oil droplets.

As the dispersion stabilizer, known ones can be used, and for example, it is preferable to use those that are soluble in an acid or an alkali, such as tricalcium phosphate, or it is preferable to use those that are decomposable by an enzyme from the perspective of environment. As the surfactant, a known anionic surfactant, cationic surfactant, nonionic surfactant, or amphoteric surfactant can be used. In addition, examples of the resin particles for improving the dispersion stability may include polymethyl methacrylate resin particles, polystyrene resin particles, and polystyrene-acrylonitrile resin particles.

Such a dispersion treatment can be conducted by utilizing mechanical energy, and such a disperser is not particularly limited, and examples thereof may include a homogenizer, a low-speed shearing type disperser, a high-speed shearing type disperser, a friction type disperser, a high-pressure jet type disperser, an ultrasonic disperser, a high-pressure impact type disperser ULTIMIZER, an emulsifying disperser, and the like.

It is preferable to heat the solution at the time of dispersion. The heating condition is not particularly limited, but it is usually about from 60 to 100° C.

The volume average particle size (volume-based median diameter) of the crystalline resin particles (oil droplets) in the dispersion of crystalline resin particles thus prepared is preferably from 60 to 1000 nm and more preferably from 80 to 500 nm. Incidentally, this volume average particle size of the oil droplets can be controlled by the magnitude of mechanical energy at the time of emulsification and dispersion.

In addition, the content of the crystalline resin particles in the dispersion of crystalline resin particles is preferably in a range of from 10 to 50% by mass and more preferably in a range of from 15 to 40% by mass relative to the total dispersion of the crystalline resin particles. It is possible to suppress the spread of particle size distribution and to improve the toner properties when the content is in such a range.

(a-2) Step of Preparing Dispersion of Amorphous Polyester Resin Particles

The step of preparing a dispersion of amorphous polyester resin particles is a step to prepare a dispersion of amorphous polyester resin particles by synthesizing an amorphous polyester resin constituting the toner base particles and dispersing this amorphous polyester resin in an aqueous medium in the form of fine particles.

The method for producing the amorphous polyester resin is as described above, and thus the description thereon is omitted here. In addition, the method for preparing the dispersion is the same as that described in step (a-1) of preparing the dispersion of crystalline resin particles described above, and thus the description thereon is omitted here.

The volume average particle size (volume-based median diameter) of the amorphous polyester resin particles (oil droplets) in the dispersion of amorphous polyester resin particles is preferably within a range of from 30 to 500 nm. Incidentally, this dispersed diameter of the oil droplets can be controlled by the magnitude of mechanical energy at the time of emulsification and dispersion.

In addition, the content of the amorphous polyester resin particles in the dispersion of amorphous polyester resin particles is preferably in a range of from 10 to 50% by mass and more preferably in a range of from 15 to 40% by mass relative to the total dispersion of amorphous polyester resin particles. It is possible to suppress the spread of particle size distribution and to improve the toner properties when the content is in such a range.

(a-3) Step of Preparing Dispersion of Colorant Particles

The step of preparing a dispersion of colorant particles is a step to prepare a dispersion of colorant particles by dispersing a colorant in an aqueous medium in the form of fine particles.

The aqueous medium is as described in (a-1) above, and a surfactant or resin particles may be added into the aqueous medium for the purpose of improving the dispersion stability.

The dispersion of the colorant can be conducted by utilizing mechanical energy, and such a disperser is not particularly limited, and those described in (a-1) above can be used.

The volume average particle size (volume-based median diameter) of the colorant particles in the dispersion of colorant particles is preferably within a range of from 10 to 300 nm.

The content of the colorant particles in the dispersion of colorant particles is preferably in a range of from 10 to 50% by mass and more preferably in a range of from 15 to 40% by mass relative to the total dispersion of colorant particles. An effect of securing the color reproducibility can be obtained when the content is in such a range.

(a-4) Step of Preparing Dispersion of Release Agent Particles

The step of preparing a dispersion of colorant particles is a step to be conducted if necessary in the case of desiring the toner base particles containing a release agent, and it is a step to prepare a dispersion of release agent particles by dispersing a release agent in an aqueous medium in the form of fine particles.

The aqueous medium is as described in (a-1) above, and a surfactant or resin particles may be added into the aqueous medium for the purpose of improving the dispersion stability.

The dispersion of the release agent can be conducted by utilizing mechanical energy, and such a disperser is not particularly limited, and those described in (a-1) above can be used.

The volume average particle size (volume-based median diameter) of the release agent particles in the dispersion of release agent particles is preferably within a range of from 10 to 300 nm.

The content of the release agent particles in the dispersion of release agent particles is preferably in a range of from 10 to 50% by mass and more preferably in a range of from 15 to 40% by mass relative to the total dispersion of release agent particles. An effect of preventing hot offset and securing the separation property can be obtained when the content is in such a range.

(b) Step of Aggregating and Fusing Core Particles

This step of aggregating and fusing core particles is a step to aggregate the crystalline resin particles, amorphous polyester resin particles, colorant particles, and if necessary, release agent particles described above in an aqueous medium and to fuse these particles at the same time with the aggregation.

In this step, first, the crystalline resin particles, the amorphous polyester resin particles, the colorant particles, and if necessary, the release agent particles are mixed together and these particles are dispersed in an aqueous medium.

Next, an aggregating agent is added to the dispersion, the dispersion is then heated at a temperature higher than the glass transition temperatures of the crystalline resin particles and the amorphous polyester resin particles to advance the aggregation, and the resin particles are fused with one another at the same time.

In the present invention, it is preferable to use a method in which the aggregation and fusion are conducted in the presence of a compound to be the supply source of aluminum. That is, it is preferable that the compound to be the supply source of aluminum is a compound to serve a function of an aggregating agent. In the above form, there is an advantage that a decrease in physical property of the toner due to an extra additive can be suppressed and the producing process can be also simplified. The compound to be the supply source of aluminum is described above, and thus the detailed description thereon is omitted here. Incidentally, the chloride or sulfate of a divalent metal described above may be added as the aggregating agent other than the compound to be the supply source of aluminum.

The amount of the compound to be the supply source of aluminum used is not particularly limited, but it is, for example, from 1 to 5 parts by mass and preferably from 1.5 to 4.8 parts by mass relative to 100 parts by mass of the solid content of the binder resin (here, the total amount of these resins when the binder resin is constituted by two or more kinds of resins, for example, particles having a core-shell structure) constituting the toner base particles. The concentration of aluminum in the toner base particles is likely to be controlled in the desired range when the amount of the compound to be the supply source of aluminum used is in the above range although it also depends on the kind of the compound.

In addition, the amount of a chloride or sulfate of a divalent metal used is not particularly limited as long as the effect of the present invention is not impaired in a case in which the chloride or sulfate of a divalent metal is added as an aggregating agent. The used amount is, for example, from 1 to 5 parts by mass relative to 100 parts by mass of the solid content of the binder resin constituting the toner base particles.

The compound to be the supply source of aluminum may be added to the dispersion of resin particles for aggregation in the form as it is, or the compound in the state of being dissolved or dispersed in an aqueous medium in advance may be added to the dispersion of resin particles for aggregation. The form to add the compound to be the supply source of aluminum to the dispersion of resin particles for aggregation is also not particularly limited, but preferably the compound is added over from 1 to 20 minutes while being stirred.

In the aggregation step, it is preferable that a time period during which the dispersion is allowed to stand after the addition of the compound to be the supply source of aluminum as an aggregating agent (until heating is started) is set as short as possible. That is, it is preferable to start heating of the dispersion of resin particles for aggregation as quickly as possible after the compound to be the supply source of aluminum is added thereto and to raise the temperature to the glass transition temperature of the resin for core or higher as quickly as possible. The reason for this is not clear, but this is because it is concerned that the aggregation state of the particles varies with the passage of the standing time and thus a problem might be caused that the particle size distribution of the toner base particles to be obtained is unstable or the surface property fluctuates. The standing time is usually within 30 minutes and preferably within 10 minutes.

In addition, in the aggregation step, it is preferable to quickly raise the temperature by heating after the aggregating agent is added and to set the temperature rising rate to 0.8° C./min or more. The upper limit of the temperature rising rate is not particularly limited, but it is preferably set to 15° C./min or less from the viewpoint of suppressing the generation of coarse particles due to the rapid progress of fusion. Furthermore, it is important that after the temperature of the dispersion for aggregation reaches the desired temperature, the temperature of the dispersion for aggregation is maintained in a certain time, preferably until the volume-based median diameter reaches 4.5 to 7.0 μm, and thus, the fusion is continued (first aging step).

(c) Step of Forming Shell Layer

In order to obtain a toner having a core-shell structure, after the first aging step describe above, a dispersion of amorphous polyester resin particles to form a shell layer is further added to the dispersion for aggregation and the amorphous polyester resin particles to form a shell layer is aggregated and fused on the surface of the particles (core particles) of the binder resin obtained in the above. By this, the toner base particles having a core-shell structure can be obtained. Moreover, the aggregation is terminated by adding a salt such as an aqueous solution of sodium chloride when the size of the aggregated particles reaches the target size. Thereafter, the heat treatment of the reaction mixture may be further conducted until the shell layer is more firmly aggregated and fused on the surface of core particles and the shape of the particles becomes a desired shape (second aging step). This second aging step may be conducted until the average circularity of the toner base particles having a core-shell structure is in the average circularity range described above.

This makes it possible to effectively advance the growth (aggregation of the crystalline resin particles, amorphous polyester resin particles, colorant particles, and if necessary, release agent particles) and fusion (disappearance of the interface between the particles) of particles and to improve the durability of the toner particles to be finally obtained.

(d) Cooling Step

The cooling step is a step to subject the dispersion of toner base particles to a cooling treatment. The cooling rate in the cooling treatment is not particularly limited, but it is preferably from 0.2 to 20° C./min. The cooling treatment method is not particularly limited, and examples thereof may include a method in which cooling is conducted by introducing a coolant from the outside of the reaction vessel and a method in which cooling is conducted by directly introducing cold water into the reaction mixture.

(e) Filtration, Cleaning, and Drying Step

In the filtration step, the toner base particles are separated from the dispersion of toner base particles through filtration. The filtration treatment method is not particularly limited, and there are a centrifugation method, a vacuum filtration method using the Nutsche or the like, and a filtration method using a filter press or the like.

Subsequently, the deposits such as the surfactant or the aggregating agent are removed from the separated toner base particles (cake-like aggregate) by being cleaned in the cleaning step. With regard to the cleaning treatment, water cleaning treatment is conducted until the electric conductivity of the filtrate reaches, for example, a level of from 5 to 10 μS/cm.

In the drying step, the toner base particles subjected to the cleaning treatment is subjected to the drying treatment. Examples of the dryer to be used in this drying step may include a known dryer such as a spray dryer, a flash jet dryer, a vacuum freeze dryer, and a vacuum dryer, and it is also possible to use a static shelf dryer, a mobile rack dryer, a fluidized bed dryer, a rotary dryer, a stirring dryer, and the like. The amount of moisture contained in the dried toner base particles is preferably 5% by mass or less and more preferably 2% by mass or less.

In addition, a crushing treatment may be conducted in a case in which the dried toner base particles are aggregated with one another via a weak attractive force between the particles. Here, it is possible to use a mechanical crushing apparatus such as a jet mill, the Henschel mixer, a coffee mill, a food processor as the apparatus for crushing treatment.

(f) Step of Treating with External Additive

This step is a step to produce a toner by adding an external additive to the surface of the toner base particles subjected to the drying treatment if necessary and mixing them together. By the addition of an external additive, the fluidity or electrification properties of the toner can be improved and also the improvement of the cleaning property and the like are realized.

[Developer]

The color toner can be used as a magnetic or non-magnetic one-component developer, but it may be used as a two-component developer by being mixed with a carrier. It is possible to use magnetic particles composed of the materials known in the related art, such as metals such as iron, ferrite, and magnetite, and alloys of these metals with metals such as aluminum and lead, and particularly ferrite particles are preferable as the carrier in the case of using the toner as a two-component developer. In addition, as the carrier, a coated carrier in which the surface of the magnetic particles is covered with a covering agent such as a resin or a dispersion type carrier formed by dispersing a fine magnetic material powder in a binder resin may be used.

The volume-based median diameter of the carrier is preferably from 20 to 100 μm and more preferably from 25 to 80 μm. The volume-based median diameter of the carrier can be typically measured by using the laser diffraction particle size distribution measuring apparatus equipped with a wet disperser "HELOS" (manufactured by Sympatec GmbH).

[Image Forming Method]

The image forming method according to the present invention includes forming an image forming layer on a recording medium by using the color toner (toner for electrostatic charge image development) described above. That is, the present invention provides an image forming method using a yellow toner, a magenta toner, and a cyan toner, and in which the yellow toner, the magenta toner, and the cyan toner respectively contain toner base particles containing a binder resin containing an amorphous polyester resin as a main component and a crystalline resin, aluminum, and a colorant, and Al (Y), Al (M), and Al (C) are from 300 to 1500 ppm and satisfy the Formula (1) and Formula (2) described above wherein Al (Y) (unit: ppm) is a concentration of aluminum in the toner base particles of the yellow toner, Al (M) (unit: ppm) is a concentration of aluminum in the toner base particles of the magenta toner, and Al (C) (unit: ppm) is a concentration of aluminum in the toner base particles of the cyan toner that are measured by high-frequency inductively coupled plasma emission spectral analysis.

The image forming method according to the present invention is a method which uses three kinds of color toners of Yellow, magenta, and cyan, and it can be preferably used as a full-color image forming method. In the full-color image forming method, it is possible to use any image forming method such as a 4-cycle system image forming method constituted by four kinds of color developing devices for each of yellow, magenta, cyan, and black and one electrostatic latent image support (also referred to as the "electrophotographic photoreceptor" or simply "photoreceptor") or a tandem system image forming method in which an image forming unit having a color developing device and the electrostatic latent image support for each color is respectively mounted for each color.

Examples of the image forming method may preferably include an image forming method including a fixing step by a thermocompression fixing system capable of heating while applying a pressure.

In this image forming method, using the color toner described above, it is possible to obtain a printed matter on which a visible image is formed, for example, by specifically developing an electrostatic latent image formed on a photoreceptor to obtain a toner image, transferring this toner image to an image support, and then fixing the toner image that is transferred to the image support on the image support by a fixing treatment of a thermocompression fixing system.

The application of pressure and heating in the fixing step are preferably conducted at the same time, and a pressure may be applied first and then heating may be conducted.

As described above, in the image forming method according to the present invention, the amount of aluminum contained in the toner base particles of the color toner to be used is within a specific range, and the amount of aluminum satisfies a specific relation (Formula (1) and Formula (2) describe above) among the respective color toners. It is presumed that, by using such color toners, the effect of improving thin paper separation property is obtained as the difference (difference between respective colors) in high temperature elasticity between the yellow toner and other color toners (magenta toner and cyan toner) decreases from the point of view of the resin elasticity (high temperature elasticity) of the respective color toners at a high temperature. That is, in the image forming method of the present invention, it is presumed that the above effect is obtained as the elasticity of the color toners to be used is moderately controlled when being heated. Hence, the effect of the present invention is particularly remarkable in the image forming method of a thermocompression fixing system.

As the fixing device of a thermocompression fixing system in the image forming method according to the present invention, various known devices can be employed. Hereinafter, a fixing device having a heat roller system and a fixing device having a belt heating system will be described as a thermocompression fixing device.

(i) Fixing Device Having Heat Roller System

The fixing device having a heat roller system is generally equipped with a roller pair consisting of a heating roller, and a pressure roller abutting on the heating roller, and the pressure roller is deformed by the pressure applied between the heating roller and the pressure roller so as to form a so-called fixing nip portion at this deformed portion.

The heating roller is generally configured by arranging a heat source consisting of a halogen lamp or the like in the inside of the core metal consisting of a hollow metal roller made of aluminum or the like, and its temperature is controlled as the core metal is heated by the heat source and the energization to the heat source is controlled so as to maintain the outer peripheral surface of the heating roller at a predetermined fixing temperature.

In a case in which the fixing device having a heat roller system is used as the fixing device of an image forming apparatus which forms a full-color image and thus it is required to have the ability to mix colors by sufficiently heating and melting at least a toner image composed of three toner layers (yellow, magenta, and cyan) and further a toner image composed of four toner layers at most, it is preferable to use, as the heating roller, a heating roller in which the core metal has a high heat capacity and an elastic layer for homogeneously melting the toner image is formed on the outer peripheral surface of the metal core.

In addition, the pressure roller is, for example, the roller having an elastic layer composed of soft rubber such as a urethane rubber or silicone rubber.

As the pressure roller, for example, a pressure roller which has a core metal consisting of a hollow metal roller made of aluminum or the like and a pressure roller which has an elastic layer formed on the outer peripheral surface of the core metal may be used.

Furthermore, in a case in which the pressure roller has a metal core, it may be configured as one in which a heat source consisting of a halogen lamp or the like is arranged in the inside of the core metal in the same manner as in the heating roller, and its temperature is controlled as the core metal is heated by the heat source and the energization to the heat source is controlled so as to maintain the outer peripheral surface of the pressure roller at a predetermined fixing temperature.

As these heating roller and/or the pressure roller, for example, it is preferable to use those in which a mold release layer composed of a fluorocarbon resin such as polytetrafluoroethylene (PTFE) or a tetrafluoroethylene-perfluoroalkyl vinyl ether copolymer (PFA) is formed as the outermost layer. The thickness of this mold release layer can be generally set to from 10 to 30 μm.

In such a fixing device having a heat roller system, heating by the heating roller and the application of pressure at the fixing nip portion are conducted by sandwiching and conveying the image support to be formed a visible image to the fixing nip portion by rotating the pair of rollers, whereby the unfixed toner image is fixed on the image support.

The image forming method of the present invention is characterized in that the low temperature fixability is also improved. Consequently, in the fixing device having a heat roller system, the temperature of the heating roller can be set to a relatively low temperature, and specifically it can be set to 115° C. or lower. Furthermore, the temperature of the heating roller is preferably 110° C. or lower and more preferably 100° C. or lower. From the viewpoint of excellent low temperature fixability, it is more preferable as the temperature of the heating roller is lower, and the lower limit value thereof is not particularly limited, but it is substantially about 90° C.

(ii) Fixing Device Having Belt Heating System

The fixing device having a belt heating system is generally one that includes a heating body consisting of a ceramic heater or the like, a pressure roller, and a fixing belt which consists of a heat-resistant belt and is sandwiched between these heating body and the pressure roller, and the pressure roller is deformed by the pressure applied between the heating body and the pressure roller so as to form a so-called fixing nip portion at this deformed portion.

As the fixing belt, a heat-resistant belt and a sheet composed of polyimide or the like, and the like can be used. In addition, the fixing belt may be one that has a heat-resistant belt or a sheet composed of polyimide or the like as a substrate and a mold release layer composed of a fluorocarbon resin such as polytetrafluoroethylene (PTFE) or a tetrafluoroethylene-perfluoroalkyl vinyl ether copolymer (PFA) formed on the substrate or one that has further an elastic layer composed of rubber or the like arranged between the substrate and the mold release layer.

In such a fixing device having a belt heating system, heating by the heating body via the fixing belt and the application of pressure at the fixing nip portion are conducted by sandwiching and conveying the image support supporting the unfixed toner image together with the fixing belt to between the fixing belt and the pressure roller which form the fixing nip portion, whereby the unfixed toner image is fixed on the image support.

According to such a fixing device having a belt heating system, the heating body may be in a state of being heated at a predetermined fixing temperature by energizing the heating body only at the time of image formation, quick start property that the standby time from the input of power to the image forming apparatus to the achievement of a state of being able to conduct the image formation is short can be obtained, the power consumption at the time of standby of the image forming apparatus is significantly small, and an advantage that power saving is achieved or the like is obtained.

As described above, the heating body, pressure roller, and fixing belt which are used as fixing members in the fixing step preferably have a configuration consisting of a plurality of layers. Furthermore, the thickness of the elastic layer belonging to these fixing members is preferably from 50 to 300 μm. When the thickness is in such a range, the fixing members are in close contact with the toner particles, thus heat is easily transmitted, and melting of the toner particles is promoted.

In the fixing device having a belt heating system, the temperature of the heating body can be set to a relatively low temperature, and specifically it can be set to 110° C. or lower. Furthermore, the temperature of the heating body is preferably 105° C. or lower and more preferably 100° C. or lower. From the viewpoint of excellent low temperature fixability, it is more preferable as the temperature of the heating body is lower, and the lower limit value thereof is not particularly limited, but it is substantially about 90° C.

(Recoding Medium)

The recording medium (also referred to as the recording material, recording paper, paper for recording, or the like) may be one that is generally used, and for example, it is not particularly limited as long as it retains the toner image formed by a known image forming method using an image forming apparatus or the like. Examples of those as the usable image support may include plain paper from thin paper to thick paper, good quality paper, art paper, or printing paper which is coated such as coated paper, commercially available Japanese paper or postcard paper, a plastic film for OHP, cloth, various kinds of resin materials used for so-called soft packaging or a resin film obtained by forming them into a film shape, and a label. In particular, the image forming method according to the present invention exhibits excellent thin paper separation property, and thus it is suitable for the case of using thin paper as a recording medium.

Embodiments of the present invention have been described above, but the present invention is not limited to the embodiments described above and can be variously modified.

EXAMPLES

Hereinafter, the effect of the present invention will be described with reference to Examples and Comparative Examples. In the following Examples, the terms "parts" and "%" respectively means "parts by mass" and "% by mass" and the respective operations are conducted at room temperature (25° C.) unless otherwise stated. Incidentally, the present invention is not limited to the following Examples.

[Analysis Conditions]

(Measurement Conditions of Glass Transition Temperature and Melting Point of Resin)

The glass transition temperature (Tg) of the amorphous polyester resin was measured by using the "Diamond DSC" (manufactured by Perkin Elmer Co., Ltd.). First, 3.0 mg of the sample (resin) for measurement was sealed in an aluminum pan, and set to the sample holder of the "Diamond DSC". An empty aluminum pan was used for the reference. Thereafter, the DSC curve was obtained by the measurement conditions (temperature raising and cooling conditions), that is, the first temperature raising process to raise the temperature from 0° C. to 200° C. at a temperature rising rate of 10° C./min, a cooling process to cool from 200° C. to 0° C. at a cooling rate of 10° C./min, and the second temperature raising process to raise the temperature from 0° C. to 200° C. at a temperature rising rate of 10° C./min were performed in this order. Based on the DSC curve obtained by this measurement, the extended line of the baseline before the rising of the first endothermic peak in the second temperature raising process and the tangential line indicating the maximum inclination between the rising portion and the peak apex of the first peak were drawn, and the intersection point thereof was adopted as the glass transition temperature (Tg).

In addition, as the melting point of the crystalline resin, the temperature of the peak top of the endothermic peak (endothermic peak having a half value width of 15° C. or less) derived from the crystalline resin in the second temperature raising process was adopted as the melting point (Tc) based on the DSC curve obtained in the same manner as the above.

(Weight Average Molecular Weight and Number Average Molecular Weight of Resin)

The molecular weight (weight average molecular weight and number average molecular weight) of the respective resins by GPC was measured in the following manner. That is, the apparatus "HLC-8120GPC" (manufactured by Tosoh Corporation) and the column "TSK guard column+TSK gel Super HZ-M three-tiered" (manufactured by Tosoh Corporation) were used, and tetrahydrofuran (THF) as the carrier solvent was circulated at a flow speed of 0.2 mL/min while keeping the column temperature at 40° C. The sample (resin) for measurement was dissolved in tetrahydrofuran so as to have a concentration of 1 mg/mL. The solution was prepared through a treatment for 5 minutes at room temperature by using an ultrasonic disperser. Subsequently the solution was treated with a membrane filter having a pore size of 0.2 μm, thereby obtaining a sample solution, and 10 μL of this sample solution was injected into the apparatus together with the carrier solvent and detected by using a refractive index detector (RI detector). The molecular weight distribution of the sample for measurement was calculated based on the calibration curve obtained by using monodispersed polystyrene standard particles. About 10 standard polystyrene samples were used for measuring the calibration curve.

Preparation of Respective Aqueous Dispersions

Production Example 1: Preparation of Aqueous Dispersion [Y] of Yellow Colorant Particles In 1600 parts by mass of ion-exchanged water, 90 parts by mass of sodium dodecyl sulfate was dissolved by stirring. While stirring this solution, 420 parts by mass of the "C.I. Pigment Yellow 74" as a colorant was gradually added to the solution, subsequently the mixture was subjected to the dispersion treatment by using the stirring apparatus "CLEARMIX" (manufactured by M Technique Co., Ltd.), thereby preparing the aqueous dispersion [Y] of yellow colorant particles in which the particles of a yellow colorant were dispersed. The volume average particle size (volume-based median diameter) of the colorant particles in this dispersion was measured by using the Microtrac particle size distribution measuring apparatus "UPA-150" (manufactured by NIKKISO CO., LTD.), and the result was 182 nm.

Production Example 2: Preparation of Aqueous Dispersion [M] of Magenta Colorant Particles The aqueous dispersion [M] of magenta colorant particles was prepared in the same manner as in the <Production Example 1: Preparation of aqueous dispersion [Y] of yellow colorant particles> described above except that the colorant was changed so that the "C.I. Pigment Red 122" was used instead of the "C.I Pigment Yellow 74". The volume average particle size (volume-based median diameter) of the colorant particles in this dispersion was measured by using the apparatus described above, and the result was 237 nm.

Production Example 3: Preparation of Aqueous Dispersion [C] of Cyan Colorant Particles The aqueous dispersion [C] of cyan colorant particles was prepared in the same manner as in the <Production Example 1: Preparation of aqueous dispersion [Y] of yellow colorant particles> described above except that the colorant was changed so that the "C.I. Pigment Blue 15:3" was used instead of the "C.I Pigment Yellow 74". The volume average particle size (volume-based median diameter) of the colorant particles in this dispersion was measured by using the apparatus described above, and the result was 194 nm.

Production Example 4: Preparation of Aqueous Dispersion [A1] of Amorphous Polyester Resin Particles (for Core)

<<Synthesis of Amorphous Polyester Resin [a1]>>

Into a reaction vessel equipped with a nitrogen inlet, a water outlet, a stirrer, and a thermocouple, propylene oxide 2 mol adduct of bisphenol A 500 parts by mass, terephthalic acid 117 parts by mass, fumaric acid 82 parts by mass and esterification catalyst (tin octylate) 2 parts by mass were introduced, subjected to the polycondensation reaction for 5 hours at 230° C., and further reacted for 1 hour at 8 kPa, the resultant was cooled to 160° C., a mixture of acrylic acid 10 parts by mass, styrene 162 parts by mass, n-butyl acrylate (BA) 42 parts by mass, and polymerization initiator (di-t-butyl peroxide) 10 parts by mass was then added into the reaction vessel dropwise over 1 hour using a dropping funnel, after the dropwise addition, the mixture was continuously subjected to the addition polymerization reaction for 1 hour while being kept at 160° C., the temperature thereof was then raised to 200° C., the resultant was kept for 1 hour at 10 kPa, and acrylic acid, styrene, and butyl acrylate were then removed, thereby obtaining the amorphous polyester resin (styrene-acrylic modified polyester resin) [a1] in which a styrene-acrylic polymerized segment and an amorphous polyester polymerized segment were bonded with each other. The glass transition temperature (Tg) of the amorphous polyester resin [a1] thus obtained was 50° C. and the weight average molecular weight (Mw) thereof was 21,000.

<<Preparation of Aqueous Dispersion [A1] of Amorphous Polyester Resin [a1] (for Core)>>

In 72 parts by mass of methyl ethyl ketone, 72 parts by mass of the amorphous polyester resin [a1] obtained in the synthesis example described above was dissolved by stirring for 30 minutes at 30° C. Next, 2.5 parts by mass of a 25% by mass aqueous solution of sodium hydroxide was added to this solution. This solution was introduced into a reaction vessel having a stirrer and 252 parts by mass of water at 30° C. was added to this solution dropwise over 70 minutes while stirring the solution so as to be mixed. The liquid in the vessel was clouded in the middle of dropwise addition, and a uniformly emulsified state was obtained after the dropwise addition of the total amount.

Subsequently, this emulsion was heated to 70° C. and stirred for 3 hours under reduced pressure of 15 kPa (150 mbar) by using the diaphragm type vacuum pump "V-700" (manufactured by BUCHI Labortechnik AG) to distill off methyl ethyl ketone, thereby preparing the aqueous dispersion [A1] of the amorphous polyester resin [a1]. The volume average particle size of the particles contained in the aqueous dispersion [A1] was measured by the laser diffraction particle size distribution measuring apparatus "LA-750" (manufactured by HORIBA, Ltd.), and the result was 162 nm.

Production Example 5: Preparation of Aqueous Dispersion [A2] of Amorphous Polyester Resin Particles (for Shell)

The amorphous polyester resin [a2] (for shell) was obtained and the aqueous dispersion [A2] of amorphous polyester resin (for shell) was produced in the same manner as in the <Production Example 4: Preparation of aqueous dispersion [A1] of amorphous polyester resin particles (for core)> described above except that the conditions for the polycondensation reaction of the amorphous polyester resin [a1] were changed, the polycondensation reaction was conducted for 8 hours at 230° C., and the resultant was further reacted for 1 hour at 8 kPa.

Incidentally, the glass transition temperature (Tg) of the amorphous polyester resin [a2] (for shell) thus obtained was 58° C. and the weight average molecular weight (Mw) thereof was 28,000. In addition, the volume average particle size of the particles contained in the aqueous dispersion [A2] was measured by the laser diffraction particle size distribution measuring apparatus "LA-750" (manufactured by HORIBA, Ltd.), and the result was 178 nm.

Production Example 6: Preparation Aqueous Dispersion [W1] of Release Agent Particles In 72 parts by mass of methyl ethyl ketone, 72 parts by mass of a release agent (behenyl behenate) was dissolved by stirring for 30 minutes at 78° C. Next, this solution was introduced into a reaction vessel having a stirrer, mixed with 252 parts by mass of water warmed at 78° C. while stirring, and subjected to the ultrasonic dispersion for 30 minutes at V-LEVEL and 300 μA by using the ultrasonic homogenizer "US-150T" (manufactured by Nippon Seiki Co., Ltd.) while stirring, thereby obtaining an emulsion.

Subsequently, this emulsion was warmed at 70° C. and stirred for 3 hours under reduced pressure of 15 kPa (150 mbar) by using the diaphragm type vacuum pump "V-700" (manufactured by BUCHI Labortechnik AG) to distill off methyl ethyl ketone, thereby preparing the aqueous dispersion [W1] in which a release agent (behenyl behenate) was dispersed. The volume average particle size of the particles contained in the dispersion [W1] was measured by the laser diffraction particle size distribution measuring apparatus "LA-750" (manufactured by HORIBA, Ltd.), and the result was 170 nm.

Production Example 7: Preparation of Aqueous Dispersion [C1] of Crystalline Polyester Resin Particles <<Synthesis of Crystalline Polyester Resin [c1]>>

The following raw material monomers of an addition polymerization-based resin (styrene-acrylic resin: StAc) segment containing a bireactive monomer and the radical polymerization initiator were filled in a dropping funnel.

styrene 34 parts by mass
n-butyl acrylate 12 parts by mass
acrylic acid 2 parts by mass, and
polymerization initiator (di-t-butyl peroxide) 7 parts by mass In addition, the following raw material monomers of a polycondensation-based resin (crystalline polyester resin: CPEs) segment were introduced into a four-neck flask equipped with a nitrogen inlet, a water outlet, a stirrer, and a thermocouple and dissolved by being heated at 170° C.

sebacic acid 281 parts by mass and
1,12-dodecanediol 283 parts by mass

Subsequently, the raw material monomers of the addition polymerization-based resin (styrene-acrylic resin: StAc) segment filled in the dropping funnel and the radical polymerization initiator were added into the four-neck flask dropwise over 90 minutes while stirring, then subjected to aging for 60 minutes, the unreacted addition polymerization monomers were then removed under reduced pressure (8 kPa). Incidentally, the amount of the monomers that were removed at this time was a significantly small amount as compared to that of the raw material monomers of the resin.

Thereafter, 0.8 parts by mass of tetrabutyl orthotitanate ($Ti(O\text{-}n\text{-}Bu)_4$) as an esterification catalyst was added into the four-neck flask, the mixture was heated up to 235° C., reacted for 5 hours at the atmospheric pressure (101.3 kPa) and further for 1 hour under reduced pressure (8 kPa).

Next, the resultant was cooled to 200° C. and reacted for 1 hour under reduced pressure (20 kPa), thereby obtaining a crystalline polyester resin [c1] of a hybrid crystalline resin. The number average molecular weight (Mn) of the crystalline polyester resin [c1] thus obtained was 9,000, and the melting point (Tc) thereof was 76° C.

<<Preparation of Aqueous Dispersion [C1] of Crystalline Polyester Resin [c1]>>

In 72 parts by mass of methyl ethyl ketone, 72 parts by mass of the crystalline polyester resin [c1] obtained in the synthesis example described above was dissolved by stirring for 30 minutes at 70° C. Next, 2.5 parts by mass of a 25% by mass aqueous solution of sodium hydroxide was added to this solution. This solution was introduced into a reaction vessel having a stirrer and 252 parts by mass of water warmed at 70° C. was added to this solution dropwise over 70 minutes while stirring the solution so as to be mixed. The liquid in the vessel was clouded in the middle of dropwise addition, and a uniformly emulsified state was obtained after the dropwise addition of the total amount.

Subsequently, this emulsion was stirred for 3 hours under reduced pressure of 15 kPa (150 mbar) by using the diaphragm type vacuum pump "V-700" (manufactured by BUCHI Labortechnik AG) to distill off methyl ethyl ketone while this emulsion was kept at 70° C., thereby preparing the aqueous dispersion [C1] of the crystalline polyester resin [c1]. The volume average particle size of the particles contained in the aqueous dispersion [C1] was measured by the laser diffraction particle size distribution measuring apparatus "LA-750" (manufactured by HORIBA, Ltd.), and the result was 125 nm.

Production of Toner

Production Example 8: Production of Yellow Toner [Y-1]

<<Preparation of Dispersion 1 of Yellow Base Particles (Aggregation and Fusion Step)>>

Into a reaction vessel equipped with a stirrer, a temperature sensor, and a cooling pipe, 231 parts by mass (in terms of solid content) of the aqueous dispersion [A1] of amorphous polyester resin particles (for core), 23 parts by mass (in terms of solid content) of the aqueous dispersion [W1] of release agent particles, and 2,000 parts by mass of ion-exchanged water were introduced, a 5 mol/L aqueous solution of sodium hydroxide was added into the reaction vessel to adjust the pH of the solution at 25° C. to 10. Thereafter, 23 parts by mass (in terms of solid content) of the aqueous dispersion [Y] of yellow colorant particles was introduced into the reaction vessel.

Subsequently, 12 parts by mass (in terms of solid content) of an aqueous solution (solid concentration: 0.3% by mass) of aluminum sulfate was added into the reaction vessel dropwise over 10 minutes to initiate the aggregation.

Thereafter, the mixture was left to stand for 3 minutes, the temperature raising was then started, the temperature of this mixture was raised to 75° C. over 60 minutes, 30 parts by mass (in terms of solid content) of the aqueous dispersion [C1] of crystalline polyester resin particles was added to the mixture over 10 minutes, and the particle growth reaction was continuously conducted while keeping the mixture at 75° C. The particle size of the associated particles was measured by the "COULTER Multisizer 3" (manufactured by Beckman Coulter, Inc.) in this state, 60 parts by mass (in terms of solid content) of the aqueous dispersion [A2] of amorphous polyester resin particles (for shell) was introduced into the mixture over 30 minutes at the time point at which the volume-based median diameter of the associated particles reached 6.0 μm, and an aqueous solution prepared by dissolving 80 parts by mass of sodium chloride in 320 parts by mass of ion-exchanged water was added to the mixture to terminate the particle growth at the time point at which the supernatant of the reaction mixture became clear.

Furthermore, the mixture was subjected to the temperature raising, heated and stirred in a state of being at 80° C. to advance fusion of the particles, and cooled to 30° C. at the time point at which the average circularity reached 0.945, thereby preparing the dispersion 1 of yellow toner base particles. Incidentally, the average circularity of the toner base particles was measured (HPF detection number was 4000) by using the measuring apparatus "FPIA-2100" (manufactured by Sysmex Corporation). In addition, the particle size of the toner base particles (associated particles) obtained in the above was measured, and the volume-based median diameter was 6.1 μm.

<<Cleaning Step and Drying Step>>

The dispersion 1 of yellow toner base particles thus obtained was subjected to the solid-liquid separation, and an operation to redisperse the dehydrated toner cake in ion-exchanged water and to subject to the solid-liquid separation was repeated three times so as to clean the toner cake, and the toner cake was dried for 24 hours at 40° C., thereby obtaining yellow toner base particles 1.

<<Step of Treating with External Additive>>

To the yellow toner base particles 1, 1.3% by mass of mixed hydrophobic silica (composed of 1% by mass of those having a number average primary particle size of 12 nm and 0.3% by mass of those having a number average primary particle size of 80 nm) and 0.3% by mass of hydrophobic titania (those having number average primary particle size of 20 nm) were added and mixed by the Henschel mixer, thereby producing the "yellow toner [Y-1]".

Production Examples 9 to 13: Production of Yellow Toners [Y-2] to [Y-6]

The yellow toners [Y-2] to [Y-6] were respectively produced in the same manner as in the <Production Example 8: Production of yellow toner [Y-1]> described above except that the amount (in terms of solid content) of the aggregating agent (aluminum sulfate) was changed as presented in the following Table 1. Incidentally, the volume-based median diameters of the respective toner base particles were within a range of from 6.0 to 6.2 μm.

Production Examples 14 to 17: Production of Magenta Toners [M-1] to [M-4]

The magenta toners [M-1] to [M-4] were respectively produced in the same manner as in the <Production Example 8: Production of yellow toner [Y-1]> described above except that the aqueous dispersion [M] of magenta colorant particles was used instead of the aqueous dispersion [Y] of yellow colorant particles and the amount (in terms of solid content) of the aggregating agent (aluminum sulfate) was changed as presented in the following Table 1. Incidentally, the volume-based median diameters of the respective toner base particles were within a range of from 6.0 to 6.3 μm.

Production Examples 18 to 21: Production of Cyan Toners [C-1] to [C-4]

The cyan toners [C-1] to [C-4] were respectively produced in the same manner as in the <Production Example 8: Production of yellow toner [Y-1]> described above except that the aqueous dispersion [C] of cyan colorant particles was used instead of the aqueous dispersion [Y] of yellow colorant particles and the amount (in terms of solid content) of the aggregating agent (aluminum sulfate) was changed as presented in the following Table 1. Incidentally, the volume-based median diameters of the respective toner base particles were within a range of from 6.0 to 6.2 μm.

[Measurement of Aluminum Content]

The amount (content) of metal elements present in the toner base particles of the respective toners obtained in Production Examples described above was measured by the following method (acid decomposition: high-frequency inductively coupled plasma emission spectral analysis).

<Pretreatment>

To 35 parts by mass of a 0.2% by mass aqueous solution of polyoxyethylene phenyl ether, 3 parts by mass of the toner thus obtained was added, dispersed therein, and treated by the ultrasonic homogenizer (US-1200T manufactured by Nippon Seiki Co., Ltd.) for 5 minutes at 25° C. to remove the external additive from the toner surface, thereby obtaining toner base particles for the measurement of the amount of metal element.

By the closed type microwave digestion apparatus "ETHOS 1" manufactured by Milestone General K.K., 100 mg of the toner base particles was decomposed with sulfuric acid and nitric acid. At this time, in a case in which there was an undecomposed substance, the target component was eluted by using hydrochloric acid, hydrofluoric acid, hydrogen peroxide, and the like. The decomposition solution was appropriately diluted with ultrapure water. In the above, the reagents used were the ultrahigh-purity reagents manufactured by KANTO CHEMICAL CO., INC.

<Measurement>

A high-frequency inductively coupled plasma emission analyzer (ICP-OES, manufactured by SII Nano Technology Inc., SPS3520UV) was used. At this time, the detection wavelengths of the respective metal elements were as follows:

Al 167.079 nm;
Mg 279.553 nm;
Fe 259.940 nm; and
Ca 393.477 nm.

Incidentally, the calibration curve was created by using a solution prepared by adding the atomic absorption standard solution for each element manufactured by KANTO CHEMICAL CO., INC. to a decomposition solution which did not contain the sample and adjusting the acid concentration to be the same as that in the sample solution. The aluminum content in the respective toner base particles are presented in the following Table 1. Incidentally, the contents of the elements (magnesium, iron, and calcium) measured other than aluminum were below the detection limit in the respective toner base particles.

TABLE 1

| | Aggregating agent (aluminum sulfate) [parts by mass] | Aluminum content [ppm by mass] |
|---|---|---|
| Yellow toner [Y-1] | 12 | 1120 |
| Yellow toner [Y-2] | 10 | 930 |
| Yellow toner [Y-3] | 15 | 1480 |
| Yellow toner [Y-4] | 6 | 450 |
| Yellow toner [Y-5] | 18 | 1820 |
| Yellow toner [Y-6] | 5 | 320 |
| Magenta toner [M-1] | 8 | 640 |
| Magenta toner [M-2] | 5 | 310 |
| Magenta toner [M-3] | 15 | 1390 |
| Magenta toner [M-4] | 4 | 240 |
| Cyan toner [C-1] | 8 | 580 |
| Cyan toner [C-2] | 5 | 300 |
| Cyan toner [C-3] | 15 | 1330 |
| Cyan toner [C-4] | 4 | 230 |

Evaluation

Examples 1-7 and Comparative Examples 1-5

The respective evaluations were conducted by using combinations (toner sets) of the yellow toner, the magenta toner, and the cyan toner described in the following Table 2.

Incidentally, two-component developers of the respective colors were obtained by adding a ferrite carrier that was covered with a silicone resin and had a volume average particle size of 60 μm to the respective color toners so as to have a toner concentration of 6% by mass and mixing them together, and these were used in the following evaluations.

<<1. Low Temperature Fixability>>

The developer composed of the toner set was filled in the commercially available full-color copying machine "bizhub PRO (registered trademark) C6501" (manufactured by Konica Minolta, Inc.) of which the fixing device had been modified so that the surface temperature of the heat roller for fixing was able to be changed in a range of from 100 to 210° C. The fixing experiment to fix a solid image having a toner deposition amount 11 g/m$^2$ on A4-size plain paper (basis weight: 80 g/m$^2$) was repeatedly conducted while changing the fixing temperature to be set from 85° C. to 130° C. so as to increase by 5° C.

Subsequently, the printed papers obtained in the fixing experiment for each fixing temperature were folded so as to apply a load to the solid image by a folding machine, the air compressed at 0.35 MPa was blown to this, the crease was ranked in 5 stages according to the following rank criteria. The fixing temperature in the fixing experiment which exhibited the lowest fixing temperature among the fixing experiments ranked to 3 was adopted as the lower limit fixing temperature. The evaluation results are presented in the following Table 2.

(Rank Criteria of Crease)

Rank 5: entirely no crease

Rank 4: partly peeled off along crease

Rank 3: peeled off in fine lines along crease

Rank 2: peeled off in thick lines along crease

Rank 1: greatly peeled off (Evaluation Criteria of Fixing Temperature)

⊙: lowest fixing temperature of 100° C. or lower

○: lowest fixing temperature of higher than 100° C. or and 110° C. or lower

Δ: lowest fixing temperature of higher than 110° C. or and 115° C. or lower x: lowest fixing temperature of higher than 115° C.

Incidentally, the lower the lowest fixing temperature is, the superior the low temperature fixability is, and the lower limit fixing temperature of 115° C. or lower is judged to be acceptable since there is no practical problem.

<<2. Thin Paper Separation Property (Separable Tip Margin Amount)>>

The two-component developers of the respective colors were sequentially filled in the commercially available full-color copying machine "bizhub PRO (registered trademark) C6501" (manufactured by Konica Minolta, Inc.). The machine was modified so that the fixing temperature, the deposition amount of toner, and the system speed were able to be freely set. As the paper for evaluation, the OK Top Coat+85 g/m$^2$ (by Oji Paper Co., Ltd.) was used. The temperature (U.O. avoiding temperature+25° C.) obtained by raising by 25° C. from the temperature (U.O. avoiding temperature) at which under offset did not occur as a reference was set to the temperature of the fixing upper belt, the temperature of the fixing lower roller was set to 90° C., the image was output by changing the tip margin amount for each of the full solid images (deposition amount: 8.0 g/m$^2$), and the tip margin amount just before the paper jam had occurred was adopted as a measure of thin paper separation performance. The separation performance is superior as the value of the separable tip margin amount is smaller. Incidentally, the evaluation was conducted in a normal temperature and normal humidity environment (NN environment: 25° C. and 50% RH). In addition, it means that the thin paper separation property is superior as the separable tip margin is smaller, and it was judged to be acceptable when the separable margin is less than 10 mm.

(Evaluation Criteria)

⊙: separable tip margin is less than 2 mm;

○: separable tip margin is 2 mm or more and less than 5 mm;

Δ: separable tip margin is 5 mm or more and less than 10 mm; and x: separable tip margin is 10 mm or more.

TABLE 2

| | | | | Aluminum amount | | | | | Evalution results | |
|---|---|---|---|---|---|---|---|---|---|---|
| | Yellow | Magenta | Cyan | Yellow Al (Y) [ppm by mass] | Magenta Al (M) [ppm by mass] | Cyan Al (C) [ppm by mass] | Al (Y)/ Al (M) | Al (Y)/ Al (CM) | Low temperature fixability (PBk) | Thin paper seperation property (PBk) |
| Example 1 | Y-1 | M-1 | C-1 | 1120 | 640 | 580 | 1.8 | 1.9 | 108° C. (○) | 1 mm (⊙) |
| Example 2 | Y-1 | M-2 | C-2 | 1120 | 310 | 300 | 3.6 | 3.7 | 102° C. (○) | 4 mm (○) |
| Example 3 | Y-2 | M-1 | C-1 | 930 | 640 | 580 | 1.5 | 1.6 | 105° C. (○) | 1 mm (⊙) |

TABLE 2-continued

| | | | | Aluminum amount | | | | | Evalution results | |
|---|---|---|---|---|---|---|---|---|---|---|
| | Yellow | Magenta | Cyan | Yellow Al (Y) [ppm by mass] | Magenta Al (M) [ppm by mass] | Cyan Al (C) [ppm by mass] | Al (Y)/ Al (M) | Al (Y)/ Al (CM) | Low temperature fixability (PBk) | Thin paper seperation property (PBk) |
| Example 4 | Y-2 | M-2 | C-2 | 930 | 310 | 300 | 3.0 | 3.1 | 98° C. (⊙) | 4 mm (○) |
| Example 5 | Y-3 | M-1 | C-1 | 1480 | 640 | 580 | 2.3 | 2.6 | 112° C. (Δ) | 1 mm (⊙) |
| Example 6 | Y-4 | M-2 | C-2 | 450 | 310 | 300 | 1.5 | 1.5 | 95° C. (⊙) | 7 mm (Δ) |
| Example 7 | Y-3 | M-2 | C-2 | 1480 | 310 | 300 | 4.8 | 4.9 | 111° C. (Δ) | 3 mm (○) |
| Comparative Example 1 | Y-5 | M-1 | C-1 | 1820 | 640 | 580 | 2.8 | 3.1 | 119° C. (X) | 0 mm (⊙) |
| Comparative Example 2 | Y-5 | M-2 | C-2 | 1820 | 310 | 300 | 5.9 | 6.1 | 116° C. (X) | 1 mm (⊙) |
| Comparative Example 3 | Y-3 | M-3 | C-3 | 1480 | 1390 | 1330 | 1.1 | 1.1 | 122° C. (X) | 0 mm (⊙) |
| Comparative Example 4 | Y-6 | M-2 | C-2 | 320 | 310 | 300 | 1.0 | 1.1 | 93° C. (⊙) | 14 mm (X) |
| Comparative Example 5 | Y-3 | M-4 | C-4 | 1480 | 240 | 230 | 6.2 | 6.4 | 107° C. (○) | 10 mm (X) |

From the results presented in Table 2, it has been revealed that the images formed by using the toner sets (image forming method) of Examples 1 to 7 exhibit excellent thin paper separation property while maintaining favorable low temperature fixability.

In contrast, it has been revealed that the images formed by using the toner sets (image forming method) of Comparative Examples 1 to 5 cannot achieve both low temperature fixability and thin paper separation property but either of the properties is inferior.

What is claimed is:

1. An image forming method using a yellow toner, a magenta toner, and a cyan toner, wherein the yellow toner, the magenta toner, and the cyan toner respectively comprise toner base particles containing a binder resin containing an amorphous polyester resin as a main component and a crystalline resin, aluminum, and a colorant, and Al (Y), Al (M), and Al (C) are from 300 to 1500 ppm and satisfy the following Formula (1) and Formula (2), wherein Al (Y) (unit: ppm) is a concentration of aluminum in the toner base particles of the yellow toner, Al (M) (unit: ppm) is a concentration of aluminum in the toner base particles of the magenta toner, and Al (C) (unit: ppm) is a concentration of aluminum in the toner base particles of the cyan toner that are measured by high-frequency inductively coupled plasma emission spectral analysis,

[Numerical Formula 1]

$$1.3 \leq Al(Y)/Al(M) \leq 5.0 \ldots \quad (1)$$

$$1.3 \leq Al(Y)/Al(C) \leq 5.0 \ldots \quad (2).$$

2. The image forming method according to claim 1, wherein the crystalline resin is a crystalline polyester resin.

3. The image forming method according to claim 1, wherein Al (Y), Al (M), and Al (C) are from 400 to 1200 ppm.

4. The image forming method according to claim 1, wherein Al (Y) is from 800 to 1200 ppm.

5. The image forming method according to claim 1, wherein Al (M) and Al (C) are from 400 to 800 ppm.

6. The image forming method according to claim 1, wherein Al (Y), Al (M), and Al (C) satisfy the following Formula (3) and Formula (4),

[Numerical Formula 2]

$$1.5 \leq Al(Y)/Al(M) \leq 3.0 \ldots \quad (3)$$

$$1.5 \leq Al(Y)/Al(C) \leq 3.0 \ldots \quad (4).$$

7. The image forming method according to claim 1, wherein the colorant contained in the yellow toner comprises a monoazo-based pigment as a main component.

8. The image forming method according to claim 7, wherein the monoazo-based pigment is at least one kind selected from C.I. Pigment Yellow 65, C.I. Pigment Yellow 74, C.I. Pigment Yellow 98, and C.I. Pigment Yellow 111.

9. A toner set comprising: a yellow toner, a magenta toner, and a cyan toner, wherein the yellow toner, the magenta toner, and the cyan toner respectively comprise toner base particles containing a binder resin containing an amorphous polyester resin as a main component and a crystalline resin, aluminum, and a colorant, and Al (Y), Al (M), and Al (C) are from 300 to 1500 ppm and satisfy the following Formula (5) and Formula (6), wherein Al (Y) (unit: ppm) is a concentration of aluminum in the toner base particles of the yellow toner, Al (M) (unit: ppm) is a concentration of aluminum in the toner base particles of the magenta toner, and Al (C) (unit: ppm) is a concentration of aluminum in the toner base particles of the cyan toner that are measured by high-frequency inductively coupled plasma emission spectral analysis,

[Numerical Formula 3]

$$1.3 \leq Al(Y)/Al(M) \leq 5.0 \ldots \quad (5)$$

$$1.3 \leq Al(Y)/Al(C) \leq 5.0 \ldots \quad (6).$$

* * * * *